US010661325B2

(12) United States Patent
Bullard

(10) Patent No.: US 10,661,325 B2
(45) Date of Patent: May 26, 2020

(54) TEXTURED HAMMER AND METHOD OF USING SAME

(71) Applicant: Wubbers, LLC, Lubbock, TX (US)

(72) Inventor: Patricia Bullard, Lubbock, TX (US)

(73) Assignee: Wubbers, LLC, Lubbock, TX (US)

( * ) Notice: Subject to any disclaimer, the term of this patent is extended or adjusted under 35 U.S.C. 154(b) by 686 days.

(21) Appl. No.: 15/299,967

(22) Filed: Oct. 21, 2016

(65) Prior Publication Data

US 2018/0111181 A1 Apr. 26, 2018

(51) Int. Cl.

| | |
|---|---|
| ***B44B 11/00*** | (2006.01) |
| ***B21D 31/06*** | (2006.01) |
| ***B25D 1/14*** | (2006.01) |
| ***B25G 1/10*** | (2006.01) |

(52) U.S. Cl.

CPC ..... *B21D 31/06* (2013.01); *B25D 1/14* (2013.01); *B25G 1/102* (2013.01); *B44B 11/00* (2013.01)

(58) Field of Classification Search

CPC .. B25D 1/14; B25D 1/02; B44B 11/04; B44B 11/00; B44B 11/02; B44C 1/24; B21D 31/06; B21D 53/44

See application file for complete search history.

(56) References Cited

U.S. PATENT DOCUMENTS 5,213,023 A * 5/1993 Floyd ..... B25D 1/06 254/26 R
5,255,575 A * 10/1993 Williams ..... B25D 1/02 81/25
2015/0360362 A1* 12/2015 Chapman ..... B25H 3/006 7/145

OTHER PUBLICATIONS

Wayback Machine 9 in 1 Sep. 5, 2015, www.web.archive.org/web/20150905083657 (Year: 2015).*
Hammered Textured Metal—Beaducation.conn, YouTube video published May 7, 2013, https://www.youtube.com/watch?v= 1YItZkaj6Uo (Year: 2013).*

* cited by examiner

*Primary Examiner* — Debra M Sullivan
(74) *Attorney, Agent, or Firm* — Vincent J. Allen; J. Miguel Hernandez; Carstens & Cahoon, LLP

(57) ABSTRACT

Disclosed are texture hammers and related methods for using the texture hammers to create textures on metallic materials without distorting the material. Such hammers may comprise having a handle and a hammer head with a first end and a second end. The first end may have an oval, square, inverted triangle, triangle, or any other shape, and may comprise indentations on the surface to create a texture. The second end may have a rectangular, triangle, or any other shape, and may also comprise indentations complementary to the indentations on the first end. The texture hammers may be used to create different textures by varying the angle the hammer strikes the material, dragging the hammer head across the surface of the material, or creating a texture border on the material.

9 Claims, 29 Drawing Sheets

TEXTURED HAMMER AND METHOD OF USING SAME

BACKGROUND

1. Technical Field

The present disclosure relates to tools for ornamenting or decorating jewelry and a method of using such tool. More particularly, the present disclosure relates to jewelry tools constructed in the form of texture hammers and related methods, which can be used to create different textures in a material.

2. Description of Related Art

Jewelers have long relied on a variety of tools to fabricate jewelry or the materials used in jewelry designs. Among the tools a jeweler or other craftsperson often employs is a tool for making textures or designs on the jewelry materials. Textured hammers are available with hammer heads of different shapes and designs, the majority of which are round and larger in scale. The ends of the hammer heads are available with a plurality of patterns, including stripes, polka dots, and interconnected triangles. The hammer heads are usually formed via a die cast, which allows hammer heads of different sizes, shapes, and textures to be fabricated.

However, the current market for texture hammers is limited to certain hammer designs. There are limited shapes of hammer heads that allow a jeweler to work on various shapes and types of metal. For example, conventional texture hammers are shaped like mallets or meat tenderizers, with little variance in the sizes or shapes of the ends of the hammer head. These large round hammer heads shaped like mallets or meat tenderizers do not allow for the detail work required for delicate jewelry making. The currently available texture hammers are not made in the shapes and sizes needed for small, delicate, detailed work. Furthermore, jewelers cannot use the currently available texture hammers in tight spots or for efficiently making consistent borders on metal. This would require precision that is currently unavailable when using existing texture hammers. The limited hammer designs now available have limited the number of methods that can be used to create new textures or new texture designs on jewelry.

The current market for texture hammers does not have hammers with complementary texture designs on the same hammer. A jeweler may decide to add a border texture to jewelry but may find that the texture hammer cannot be used for such precision work or that the texture pattern created by the texture hammer does not aesthetically complement the already existing texture pattern on the jewelry.

In view of the foregoing deficiencies of conventional approaches, the disclosed principles provide for a texture hammer tool and related methods of use that overcome the deficiencies in the prior art.

SUMMARY

The present disclosure provides tools and related methods of use for creating a design in a metallic material without distorting the material. In one embodiment, a hammer for ornamenting metallic surfaces as disclosed herein may comprise a handle with two ends as well as a hammer head attached to one of the two ends of the handle With such an exemplary hammer, the hammer head has a first end and a second end, wherein a cross-section of the first end of the hammer head is a different shape from a cross-section of the second end of the hammer head, and wherein the first end of the hammer head comprises a first plurality of indentations to create a texture on a surface of the first end of the hammer head. In addition, in exemplary embodiments, the second end of the hammer head may comprise a second plurality of indentations to create a texture on a surface of the second end of the hammer head. Moreover, in such embodiments, the second plurality of indentations may be complementary to the first plurality of indentions.

In other embodiments, a hammer for ornamenting metallic surfaces as disclosed herein may comprise a handle with two ends as well as a hammer head attached to one of the two ends of the handle. With such an exemplary hammer, a first end and the second end of the hammer head may have a triangle cross-section shape, and wherein the first end of the hammer head comprises a first plurality of indentations to create a texture on a surface of the first end of the hammer head. In addition, the second end of the hammer head may comprise a second plurality of indentations to create a texture on a surface of the second end of the hammer head, and the second plurality of indentations may be complementary to the first plurality of indentations.

In another aspect, methods for creating textures on a metallic material using a texture hammer in accordance with the disclosed principles are also disclosed. In an exemplary embodiment, such a method may comprise applying the first end of the hammer head to the metallic material, wherein applying the first end to the metallic material comprises contact between the rounded edges of the first end and the material; and creating a first texture marking on the material by the contact between the rounded edges of the first end and the material, wherein the first texture marking is different from a second texture marking created by contact between the first end and the material when the length of the hammer head is approximately perpendicular to the material.

A second exemplary method may comprise applying the first end of a hammer head to the flat material; and while the first end of the hammer head contacts the flat material, dragging the first end across the metallic material in a first direction to create a texture marking on the material. A third exemplary method may comprise applying the first end of the hammer head to a first edge of the material to create a plurality of markings on the first edge; and creating a texture border on the first edge of the material, wherein the texture border comprises the plurality of markings created by applying the first end of the hammer head to the first edge of the material.

BRIEF DESCRIPTION OF THE DRAWINGS

The present invention will be more fully understood by reference to the following detailed description of the preferred embodiments of the present invention when read in conjunction with the accompanying drawings, wherein.

Figure 1:
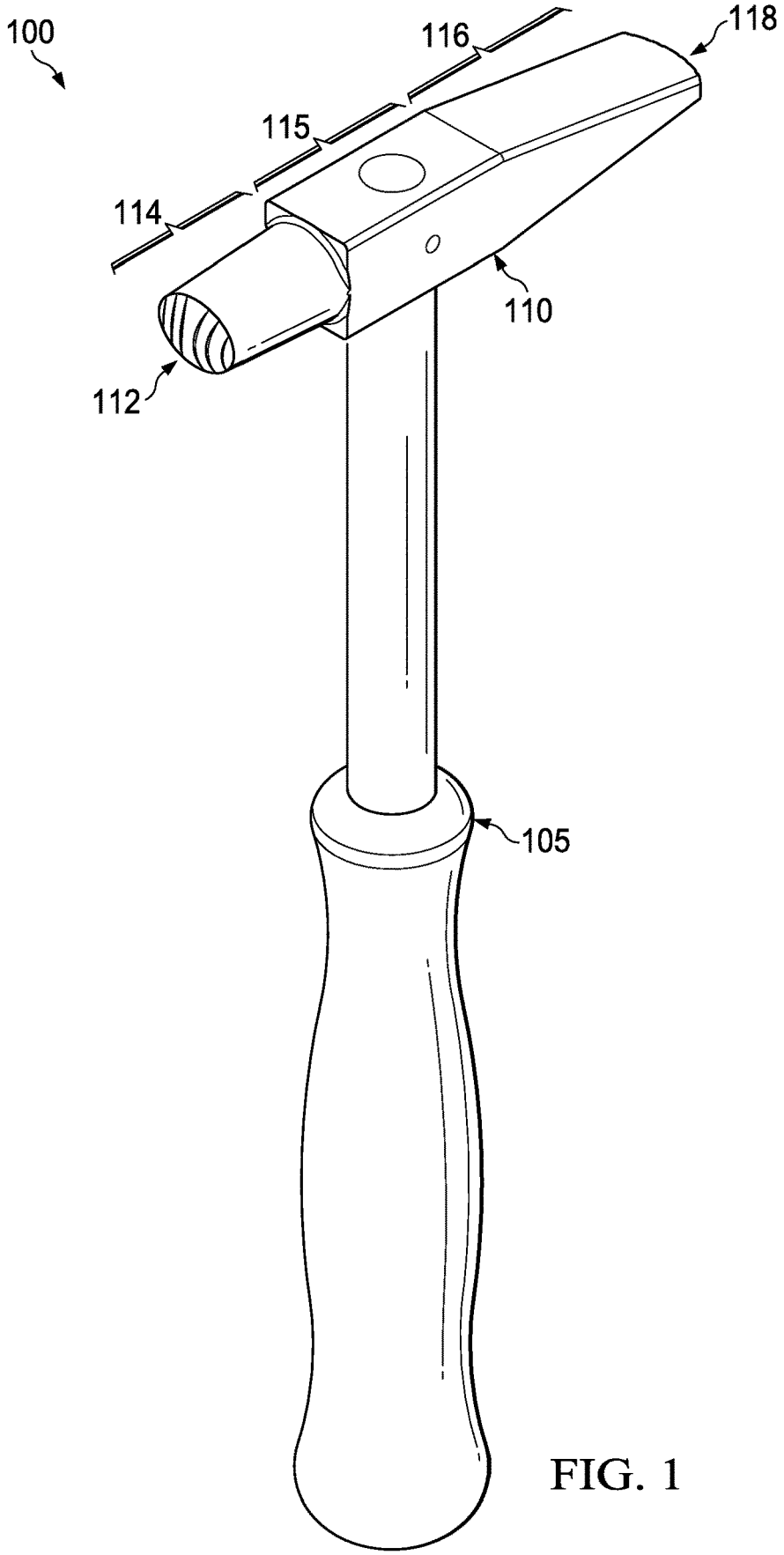
FIG. 1 is a perspective view of a texture hammer with an end of a hammer head having an oval shape in accordance with an exemplary embodiment of the present invention.

The above figures are provided for the purpose of illustration and description only, and are not intended to define the limits of the disclosed invention. Use of the same reference number in multiple figures is intended to designate the same or similar parts. Furthermore, when the terms "top," "bottom," "first," "second," "upper," "lower," "height," "width," "length," "end," "side," "horizontal," "vertical," and similar terms are used herein, it should be understood that these terms have reference only to the structure shown in the drawing and are utilized only to facilitate describing the particular embodiment. The extension of the figures with respect to number, position, relationship, and dimensions of the parts to form the preferred embodiment will be explained or will be within the skill of the art after the following teachings of the present invention have been read and understood.

DETAILED DESCRIPTION

Referring now to FIG. 1-8, illustrated are different views of a texture hammer 100 with a hammer head 110 having an oval shape end 112 in accordance with an embodiment of the disclosed principles. The hammer 100 has a handle 105 and a hammer head 110. The handle 105 of the hammer 100 may be constructed from wood, plastic, or any other rigid material, and may be designed for ergonomics and comfort when a user handles the hammer 100. The handle 105 may be polished or finished, as known and performed by those skilled in the art. As shown in the present disclosure, the shape of the handle 100, which incorporates a thick handle grip and a thinner neck that connects the handle grip and the hammer head 110, encourages correct handling of the hammer 100 so an appropriate amount of force may be applied to a metallic material to not mutilate or distort a metallic material such as used in jewelry making. Because the shape of the handle grip prevents the user from placing the forefinger in an extended position, the grip is more comfortable, placing less stress on the forearm.

The hammer head 110 of the hammer 100 may be constructed from wood, metal, plastic, or any other rigid material suitable for striking a material to create textures on the surface of another material. The hammer head 110 may be connected to the handle 105 of the hammer 105 with any means of connection, currently known or to be developed. The ends 112 and 118 of the hammer head 110, which will be further discussed below, may be polished or finished so as when the user hammers a metallic material with the hammer 100, the hammering process flattens and burnishes the material, which saves time later spent finishing the material. The shape of the hammer head 110 allows a jeweler to use the hammer 100 for tight spots or for detailed work. The hammer head 110 also allows for greater control of the hammer 100 and therefore, when the hammer 100 is used to create a texture pattern, the resulting texture pattern is more easily placed and better defined in shape than the texture pattern created by the currently available texture hammers.

The hammer head 110 may have any shape of cross-section, like a star shape or a heart shape, and FIGS. 1-8 demonstrate that one side 114 of the hammer head may have an oval cross-section while the rest of the hammer head 110 has a cross-section of another shape. In the present exemplary embodiment of the texture hammer 100, the hammer head 110 may be described with reference to three portions: an oval-cross-section portion 114, a rectangular cross-section portion 115, and a trapezoidal shape portion 116.

The oval cross-section portion 114 of the hammer head 110 may be shaped like an elliptic cylinder and may taper in shape from where it connects to the rectangular cross-section portion 115 before coming to a curved oval end 112 having a radius of curvature $R_1$. Of course, any advantageous radius of curvature may be employed for the curved oval end 112 in accordance with the disclosed principles depending on the material for texturing, and the present disclosure is not limited to any specific radius or shape. The curved oval end 112 (and the curved rectangular end 118, which is further discussed below) may be curved or rounded to prevent distortion or mutilation of the metallic material and to provide the user greater control of the hammer 100 so as to not make any unintentional markings.

The curved oval end 112 of the hammer head 110 may have indentations so as to create a texture on the surface of the curved oval end 112, and the indentations may be arranged in any manner or pattern so as to create a texture. When the curved oval end 112 of the oval cross-section side 114 of the hammer head 110 is applied to a flat metallic surface, a texture matching the curved oval end 112 is imprinted into the flat metallic surface. Alternatively, the curved oval end 112 of the hammer head 110 may have protrusions along its surface so as to create a pattern or texture when the hammer 100 is applied to a flat metallic surface.

The oval cross-section portion 114 of the hammer head 110 is connected to a rectangular cross-section portion 115 of the hammer head 110. The rectangular cross-section portion 115 of the hammer head 110 is also connected to a trapezoidal shaped portion 116 of the hammer head 110, which is further discussed below. The rectangular cross-section portion 115 of the hammer head 110 also connects the hammer head 110 to the handle 105. While in the present exemplary embodiment the rectangular cross-section portion 115 has a rectangular cross-section, in alternative embodiments, this portion may have other cross-section shapes.

Figure 2:
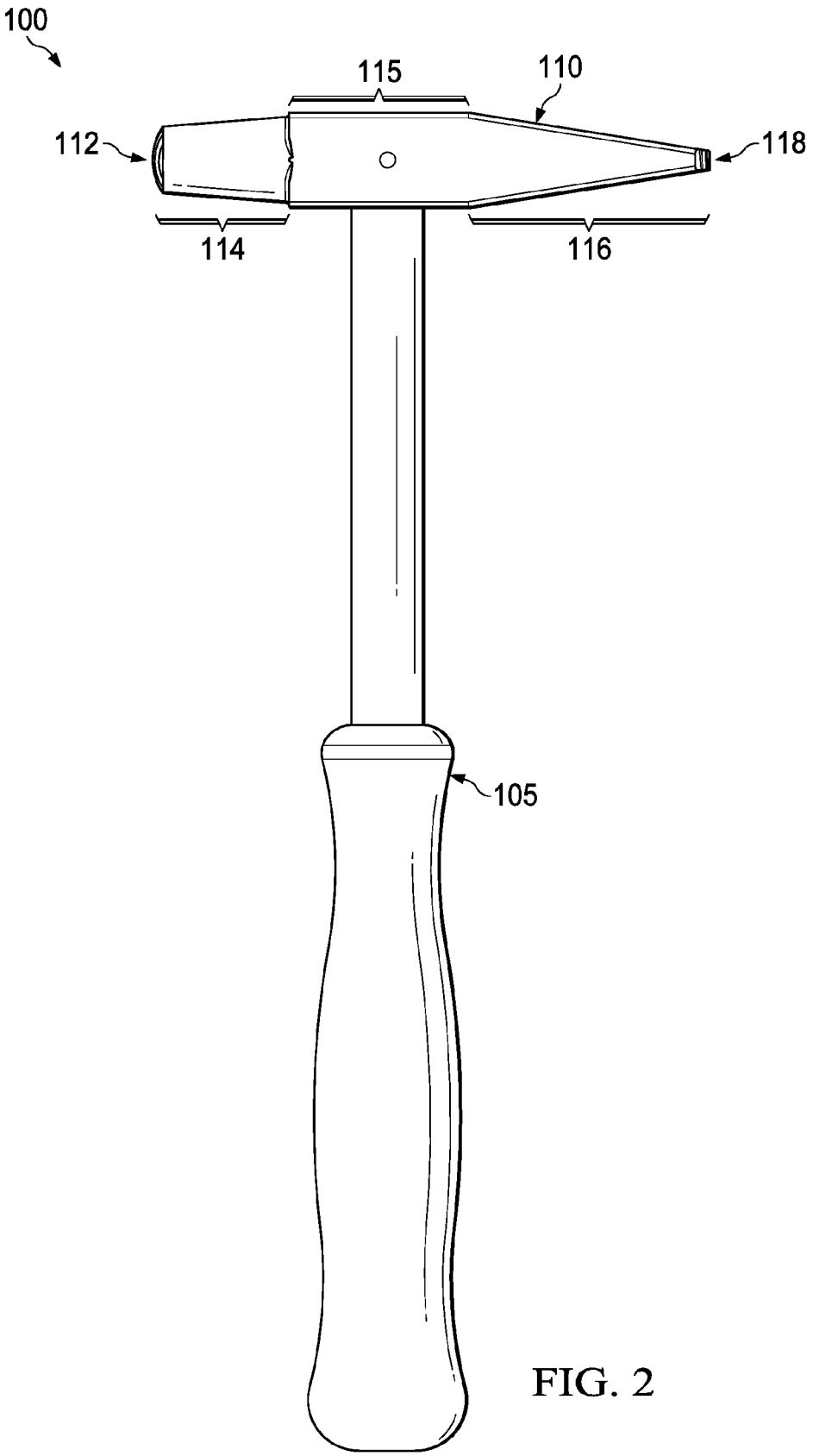
FIG. 2 is a right side view of a texture hammer with an end of a hammer head having an oval shape in accordance with an exemplary embodiment of the present invention.
Figure 3:
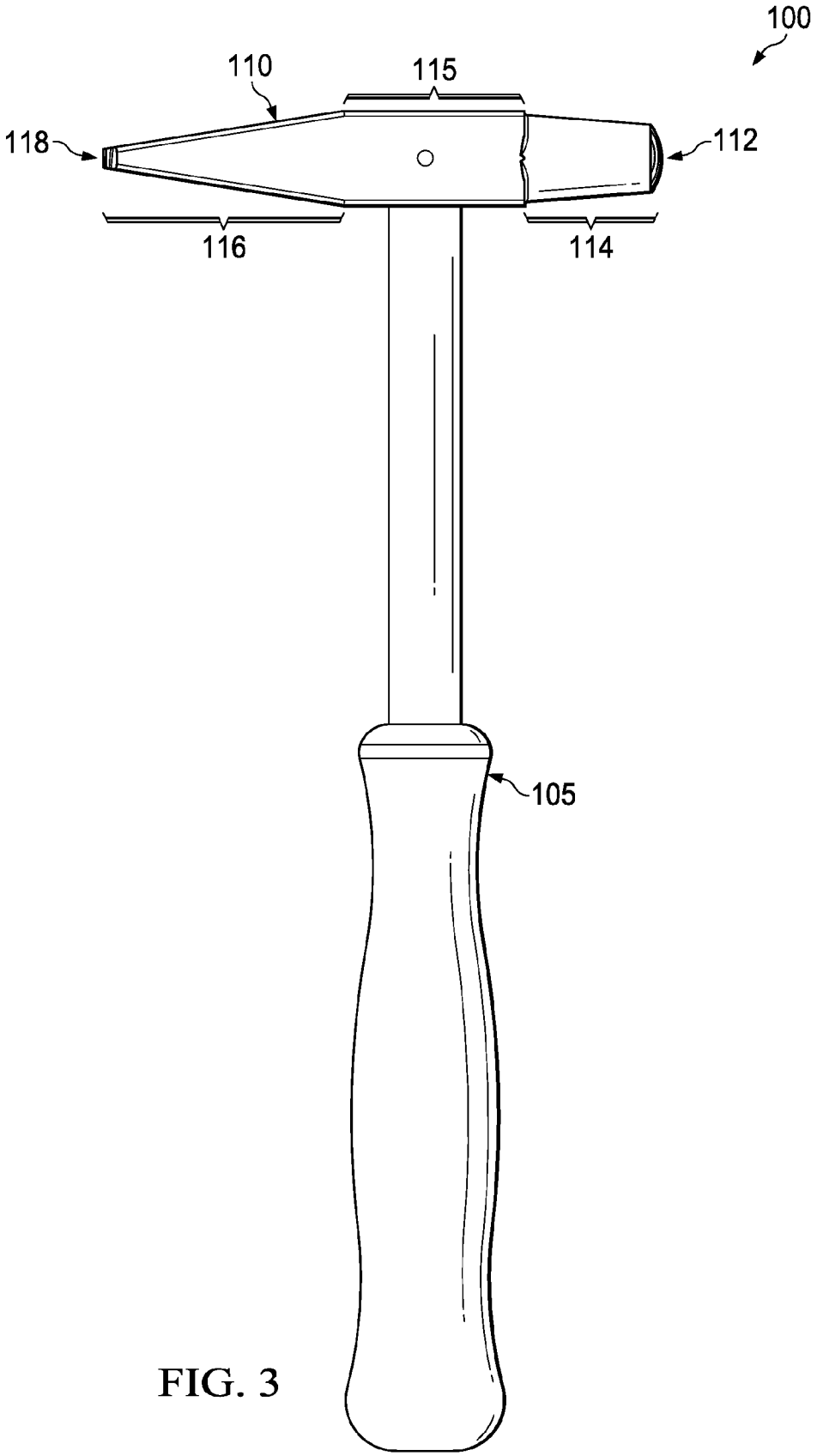
FIG. 3 is a left side view of a texture hammer with an end of a hammer head having an oval shape in accordance with an exemplary embodiment of the present invention.
Figure 4:
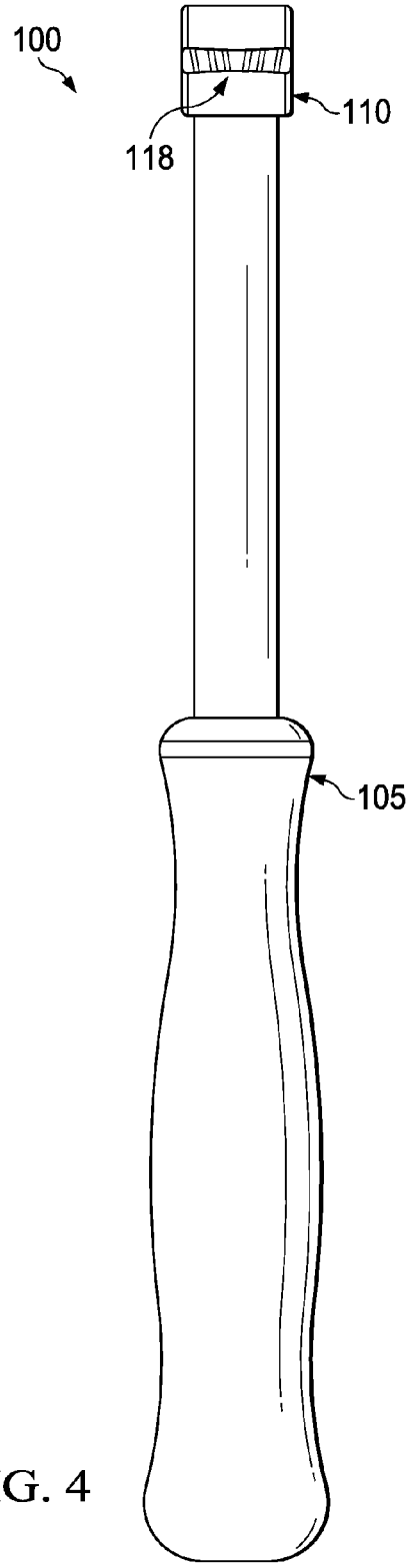
FIG. 4 is a back view of a texture hammer with an end of a hammer head having an oval shape in accordance with an exemplary embodiment of the present invention.
Figure 5:
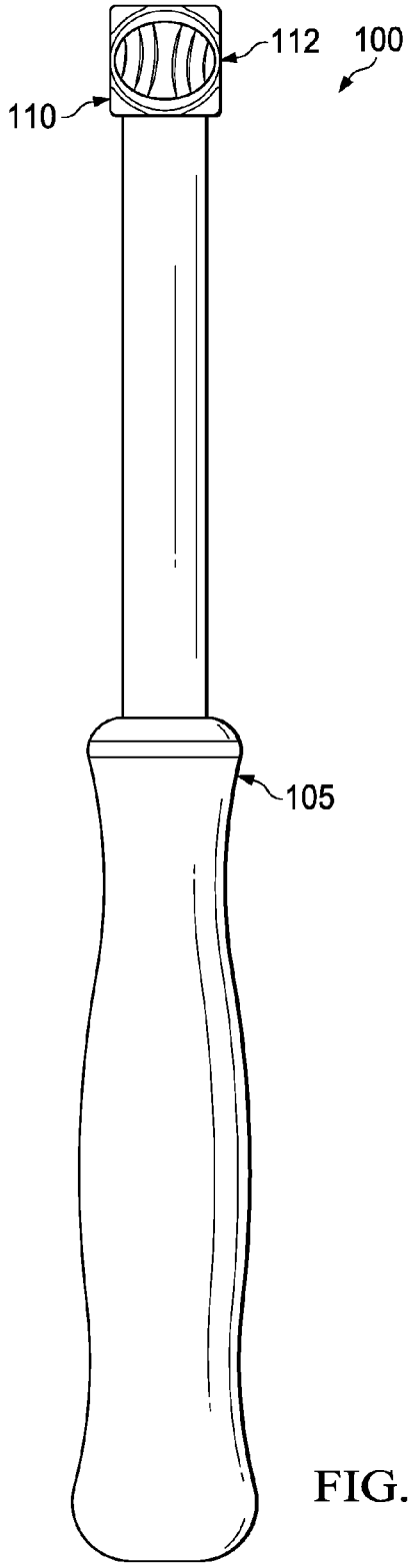
FIG. 5 is a front view of a texture hammer with an end of a hammer head having an oval shape in accordance with an exemplary embodiment of the present invention.
Figure 6:
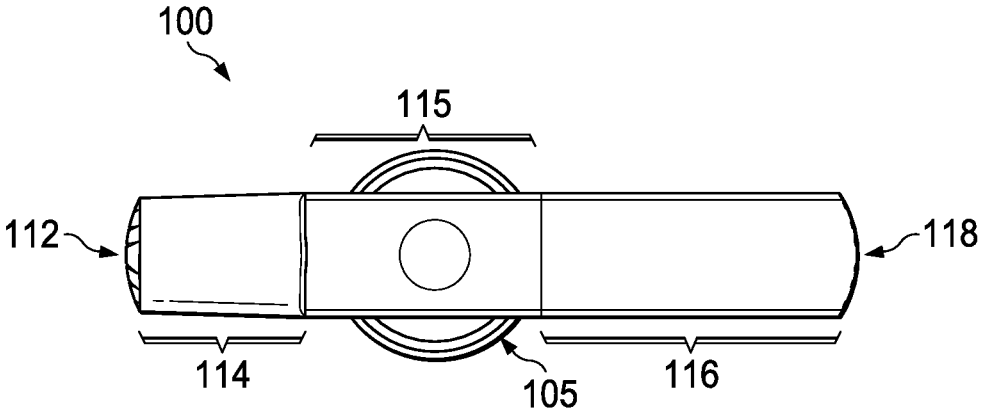
FIG. 6 is a top view of a texture hammer with an end of a hammer head having an oval shape in accordance with an exemplary embodiment of the present invention.
Figure 7:
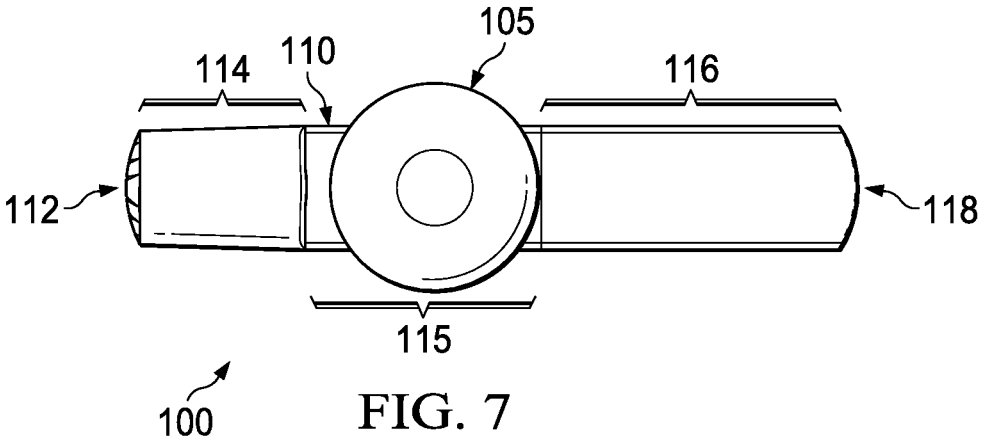
FIG. 7 is a bottom view of a texture hammer with an end of a hammer head having an oval shape in accordance with an exemplary embodiment of the present invention.
Figure 8:
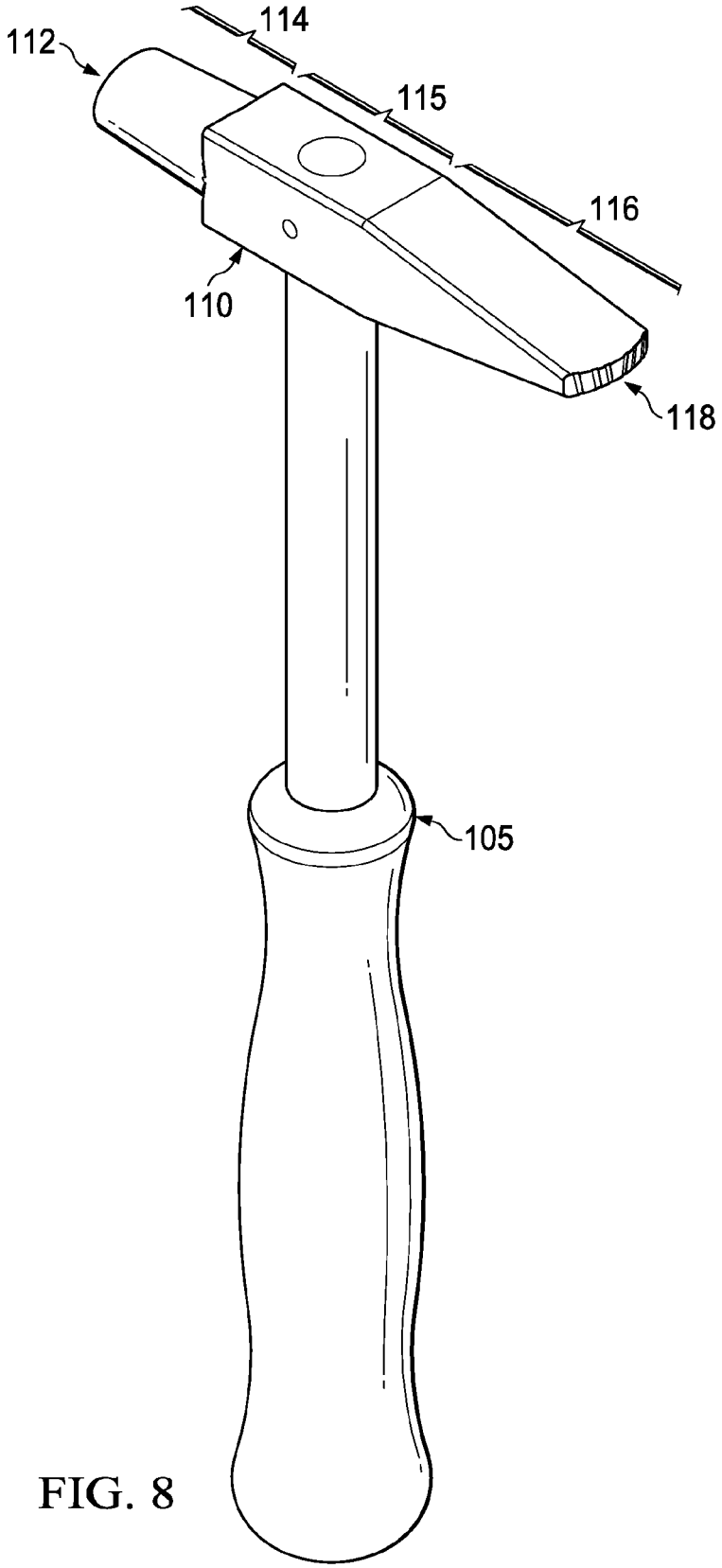
FIG. 8 is a perspective view of a texture hammer with an end of a hammer head having an oval shape in accordance with an exemplary embodiment of the present invention.
Figure 9:
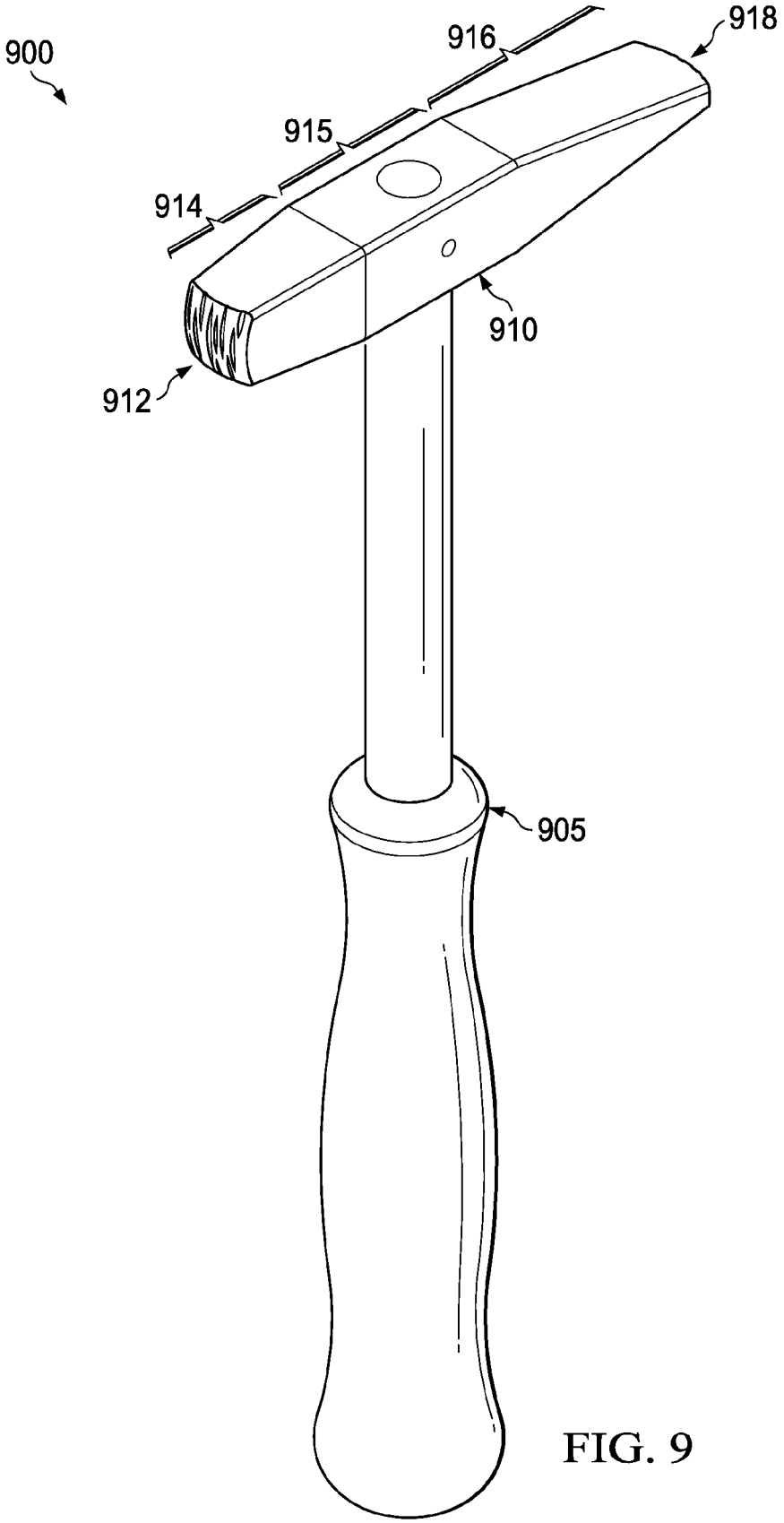
FIG. 9 is a perspective view of a texture hammer with an end of a hammer head having a square shape in accordance with an exemplary embodiment of the present invention.

Connected to the other side of the rectangular cross-section portion 115 is trapezoidal shaped portion 116 of the hammer head 110, and the trapezoidal shaped portion 116 ends with a curved rectangular end 118. The cross-section of the trapezoidal shaped portion 116 of the hammer head 110 is rectangular, and from a side view as shown in FIGS. 2 and 3, the hammer head 110 tapers in shape, like a trapezoidal prism, before coming to the curved rectangular end 118. The trapezoidal prism shape of this portion 116 allows for greater control by the user in creating finer detailed work, and for greater focus of force when using the hammer 100 to create sharper and more defined texture patterns.

The curved rectangular end 118 may also be textured via indentations in the surface of the curved rectangular end 118, like the curved oval end 112, and the indentations may be arranged in a complementary arrangement to the arrangement of indentations on the surface of the oval end 112. The curved rectangular end 118 is especially designed for making the border textures, which complement the texture on the curved oval end 112.

The present exemplary embodiment of the texture hammer 100 may be manufactured to essentially any width/depth/height combination. In the embodiment shown in FIGS. 1-8, the hammer 100 measures approximately 9.5 inches in length (from the end of the handle 105 to the top of the hammer head 110), and weights approximately 1 pound 4.2 ounces. The hammer head 110 is approximately 0.5 inches in length, approximately 4.125 inches in width (from the curved oval end 112 to the curved rectangular end 118), and approximately 0.5 inches in depth.

FIGS. 9-16 illustrate another embodiment of a texture hammer 900 with a square-shaped textured end 912. The handle 905 of texture hammer 900 may be shaped similarly and function similarly to the handle of the texture hammer 100 in FIGS. 1-8. In this present exemplary embodiment of the texture hammer 900, the hammer head 910 may have any shape of cross-section, and may comprise three portions: a square cross-section portion 914, a rectangular cross-section portion 915, and a trapezoidal shaped portion 916.

The square cross-section portion 914 of the hammer head 910 of the texture hammer 900 may be shaped like a rounded rectangular prism and may taper in shape from where it connects to the rectangular cross-section portion 915 before into a curved square end 912. The curved square end 912 may have indentations so as to create a texture on the surface of the curved square end 912, and the indentations may be arranged in any manner so as to create a pattern. The curved square end 912 (and the curved rectangular end 918, which is further discussed below) may be curved or rounded to prevent distortion or mutilation of the metallic material and to provide the user greater control of the hammer 900 so as to not make any unintentional markings.

The rectangular cross-section portion 915 of the hammer head 910 is connected to the square cross-section portion 914 and to the trapezoidal shaped portion 916 of the hammer head 910. The rectangular cross-section portion 915 of the hammer head 910, in this second exemplary embodiment, is similar to the rectangular cross section portion 115 of the oval texture hammer 100, and acts to connect the hammer head 910 to the handle 905. While in the present exemplary embodiment, the rectangular cross-section portion 915 has a rectangular cross-section, in alternative embodiments, this portion may have other cross-section shapes.

Figure 10:
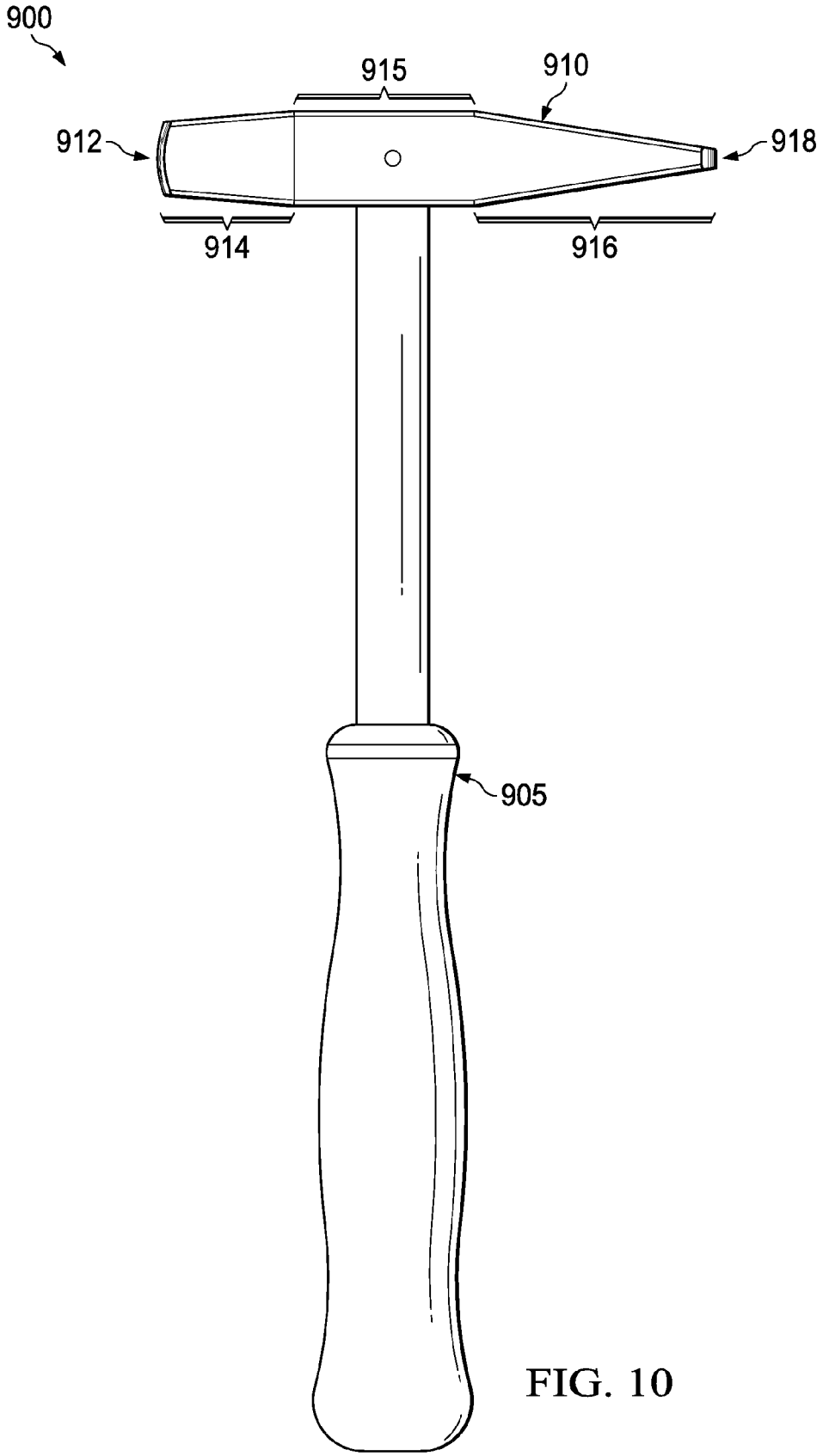
FIG. 10 is a right side view of a texture hammer with an end of a hammer head having a square shape in accordance with an exemplary embodiment of the present invention.
Figure 11:
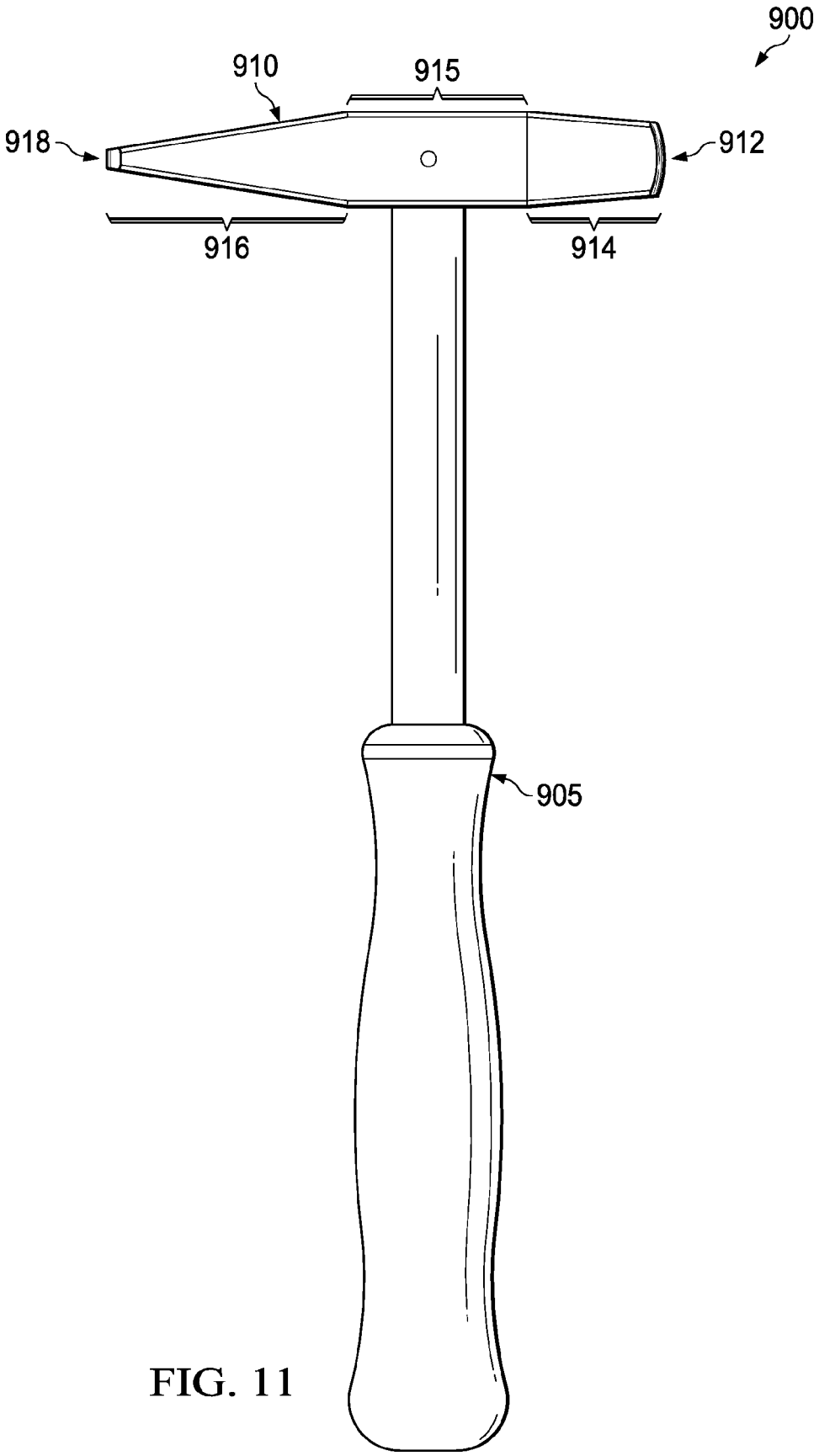
FIG. 11 is a left side view of a texture hammer with an end of a hammer head having a square shape in accordance with an exemplary embodiment of the present invention.
Figure 12:
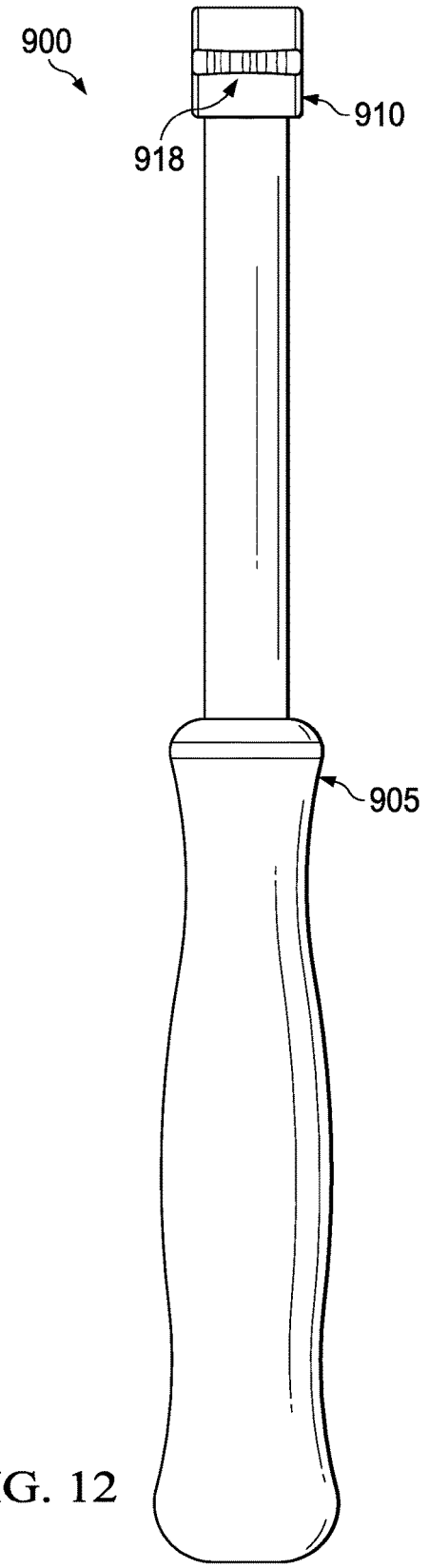
FIG. 12 is a back view of a texture hammer with an end of a hammer head having a square shape in accordance with an exemplary embodiment of the present invention.
Figure 13:
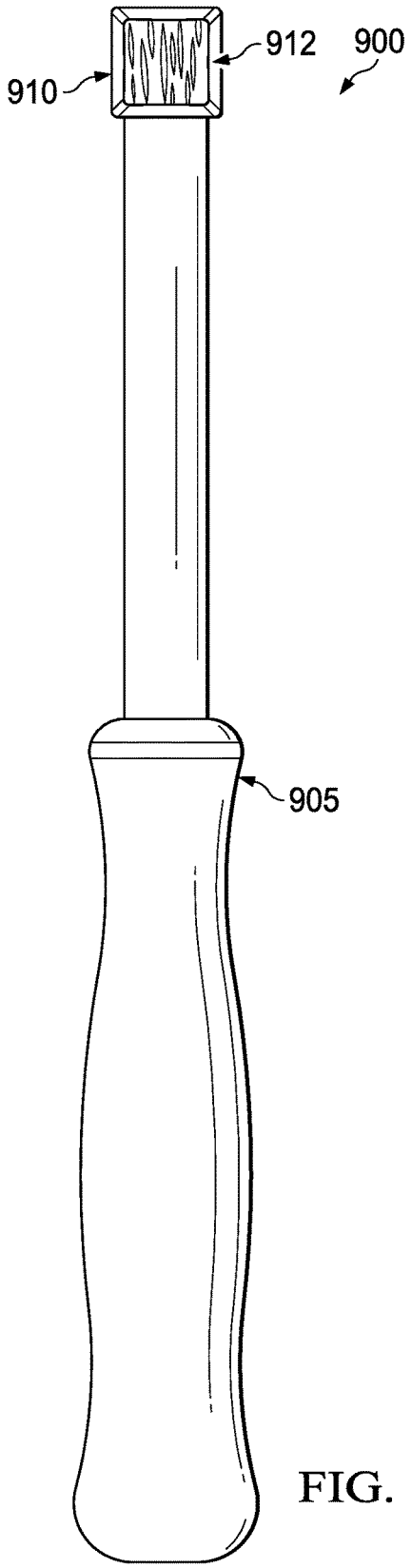
FIG. 13 is a front view of a texture hammer with an end of a hammer head having a square shape in accordance with an exemplary embodiment of the present invention.
Figure 14:
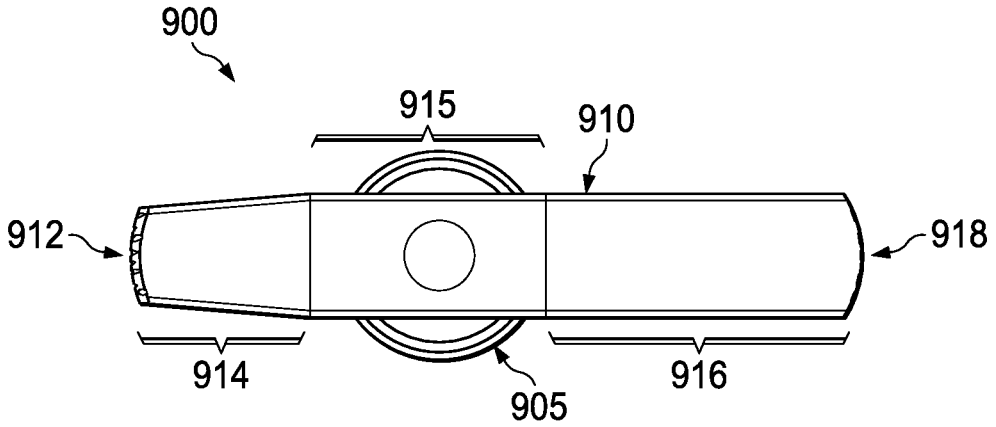
FIG. 14 is a top view of a texture hammer with an end of a hammer head having a square shape in accordance with an exemplary embodiment of the present invention.
Figure 15:
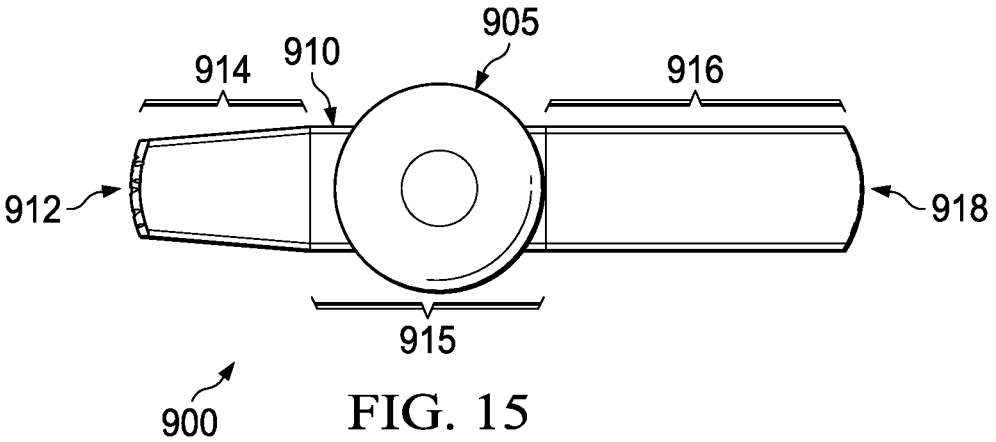
FIG. 15 is a bottom view of a texture hammer with an end of a hammer head having a square shape in accordance with an exemplary embodiment of the present invention.
Figure 16:
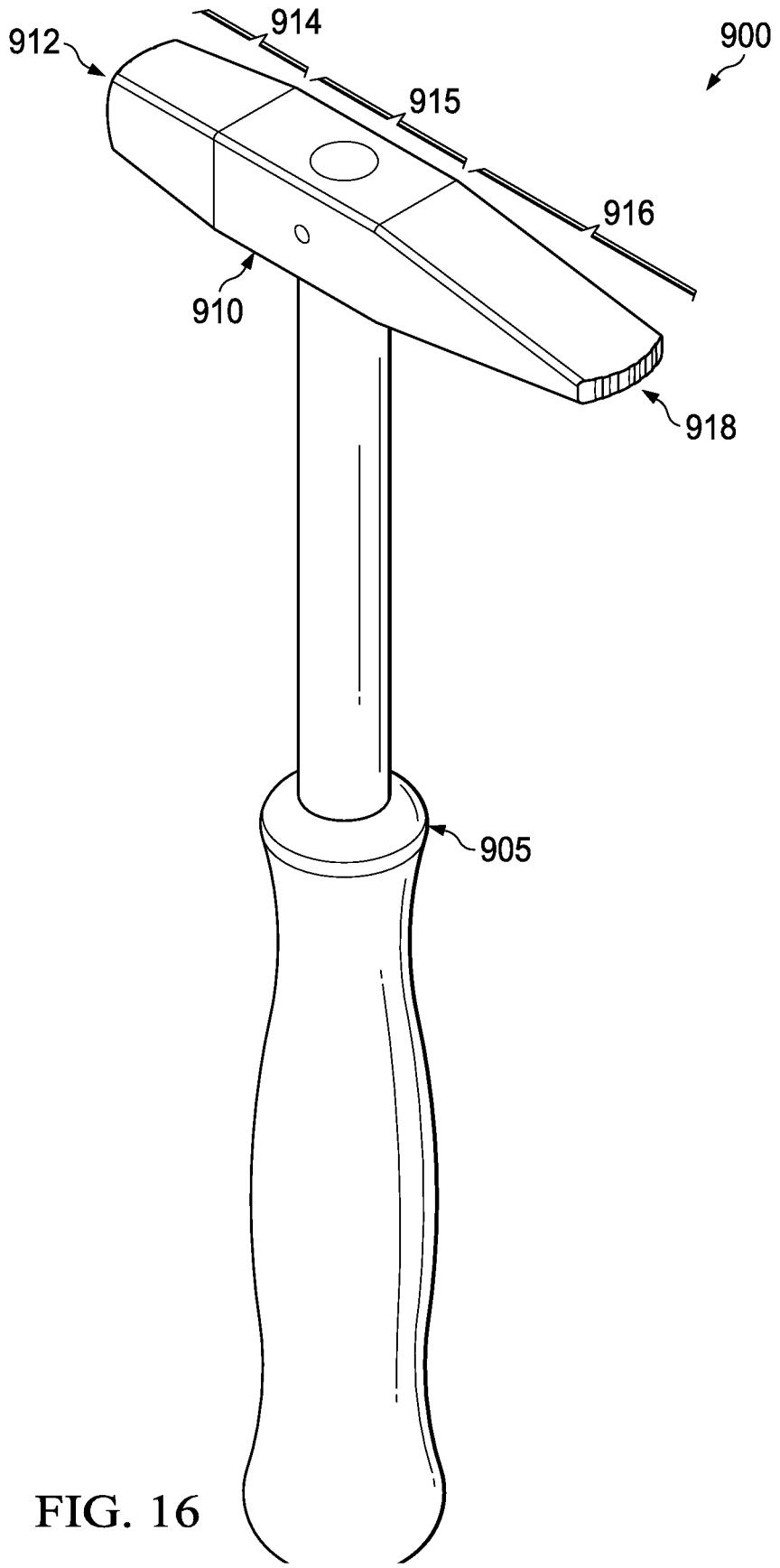
FIG. 16 is a perspective view of a texture hammer with an end of a hammer head having a square shape in accordance with an exemplary embodiment of the present invention.
Figure 17:
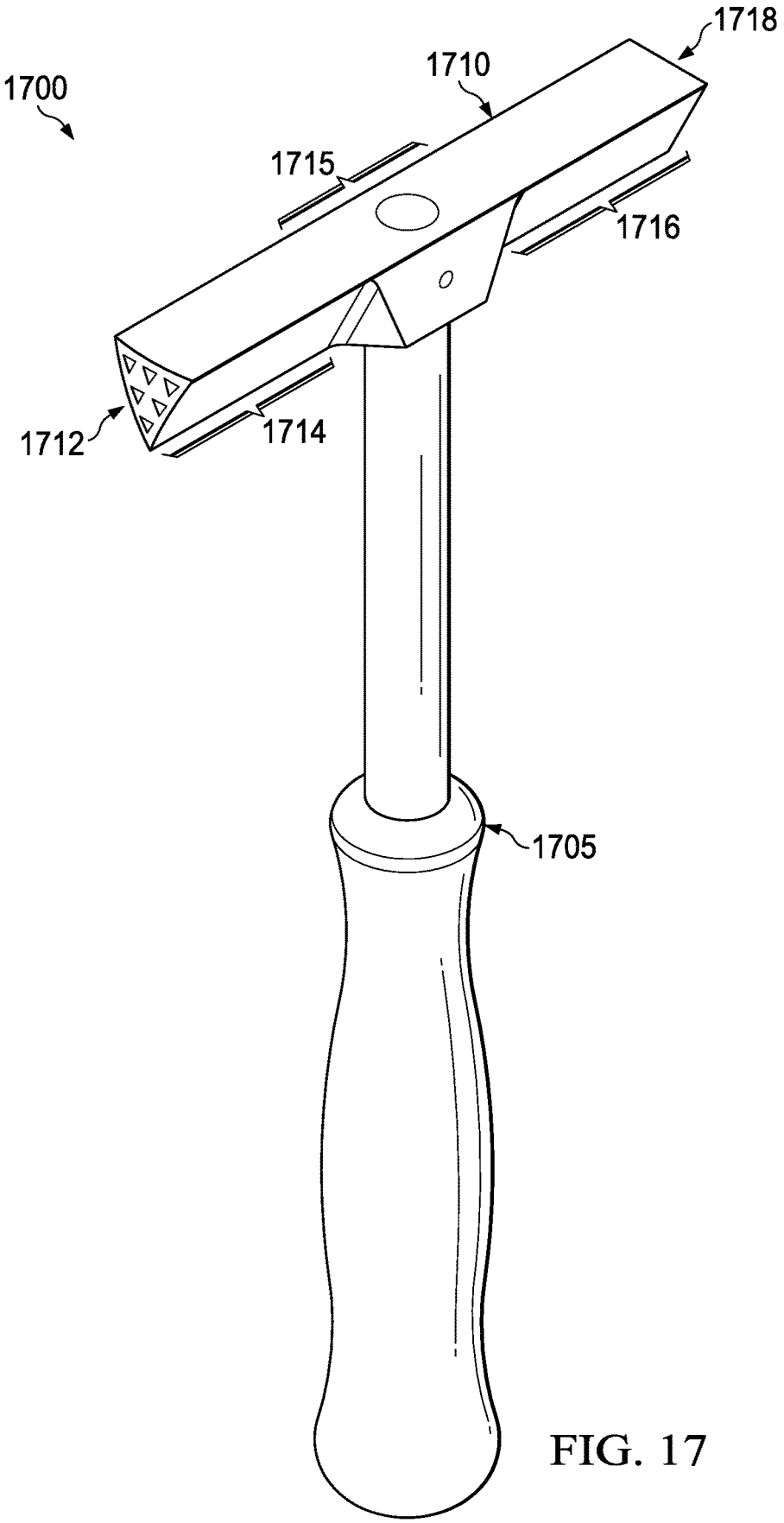
FIG. 17 is a perspective view of a texture hammer with ends of a hammer head having an inverted triangle shape in accordance with an exemplary embodiment of the present invention.
Figure 18:
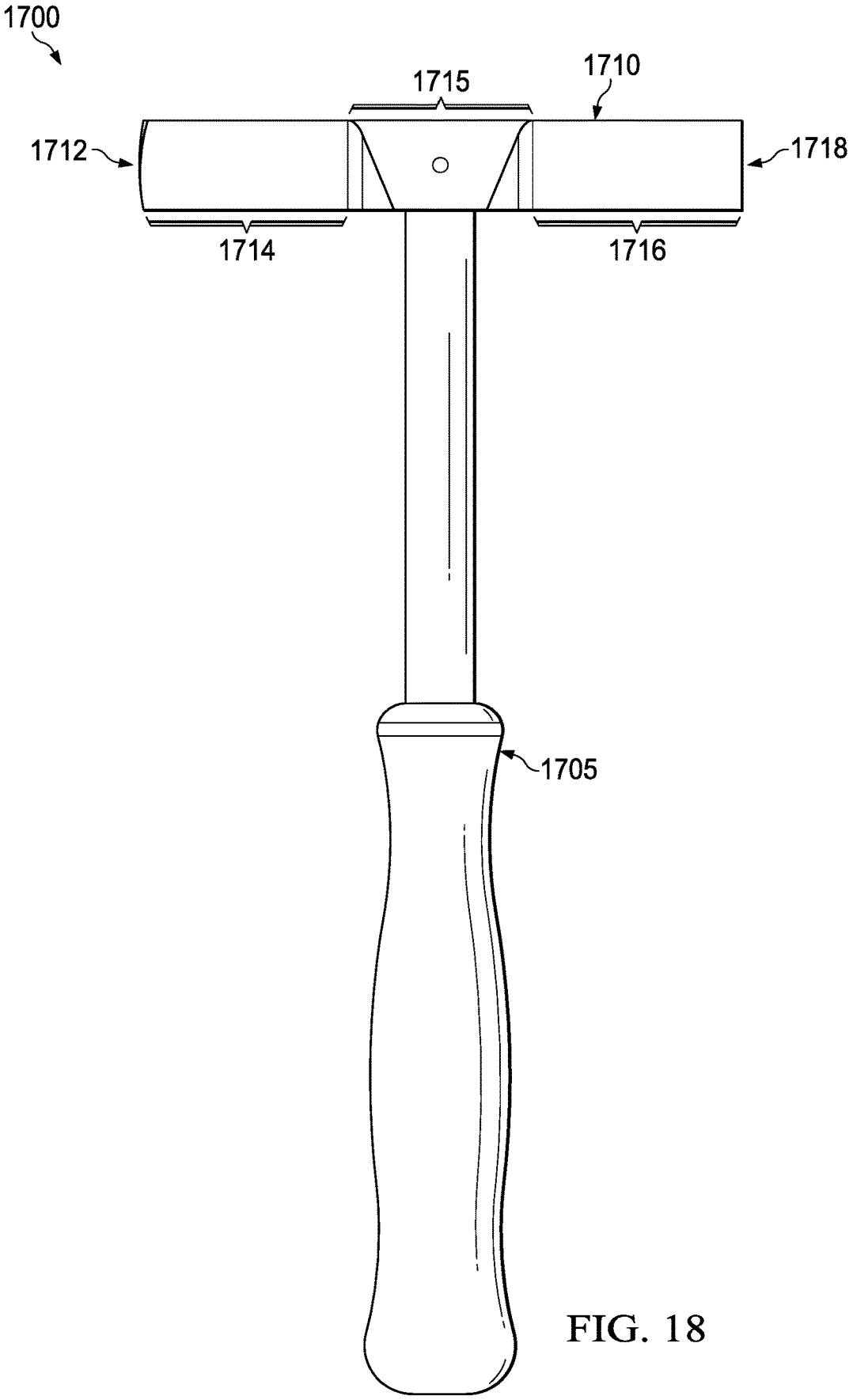
FIG. 18 is a right side view of a texture hammer with ends of a hammer head having an inverted triangle shape in accordance with an exemplary embodiment of the present invention.
Figure 19:
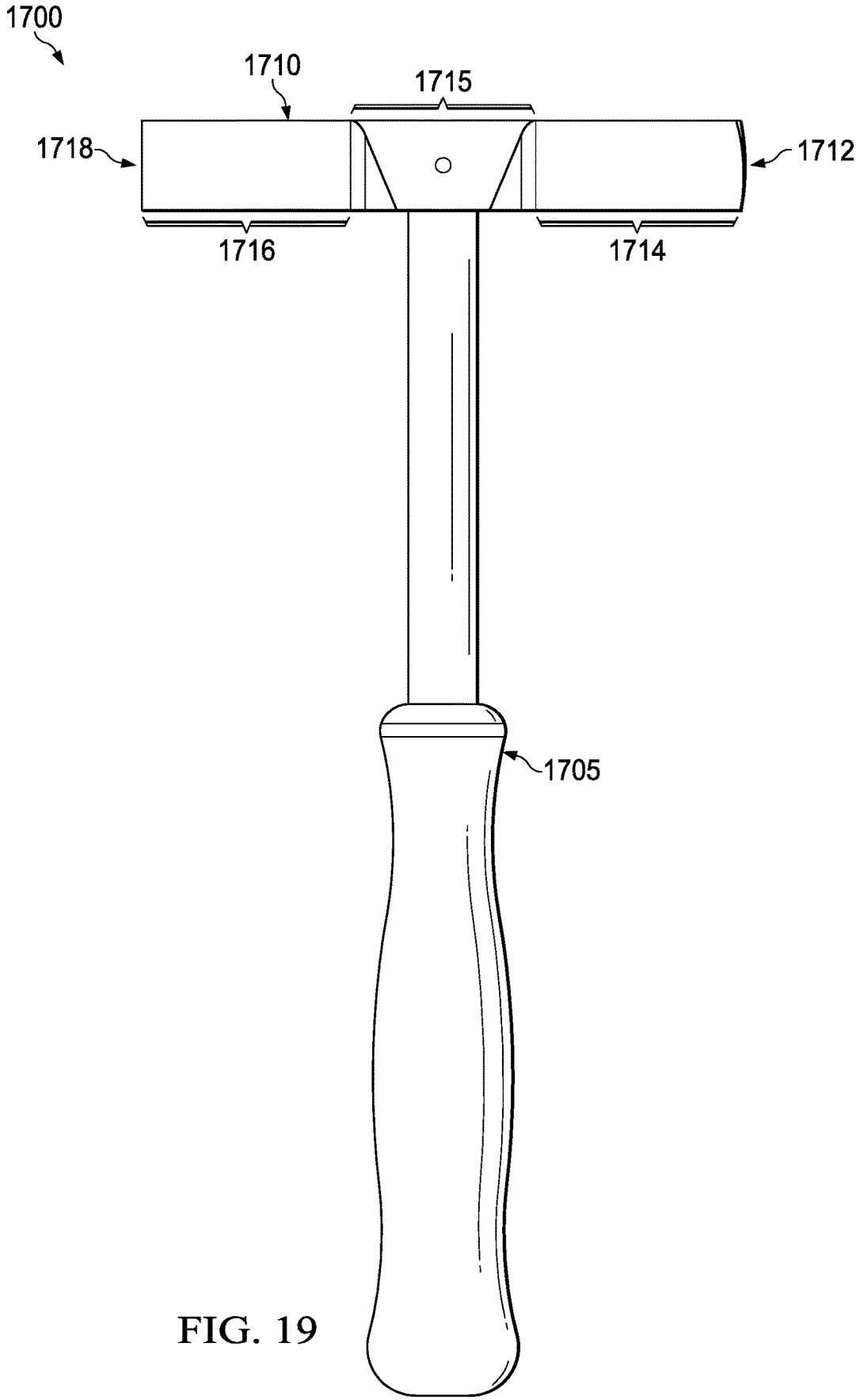
FIG. 19 is a left side view of a texture hammer with ends of a hammer head having an inverted triangle shape in accordance with an exemplary embodiment of the present invention.
Figure 20:
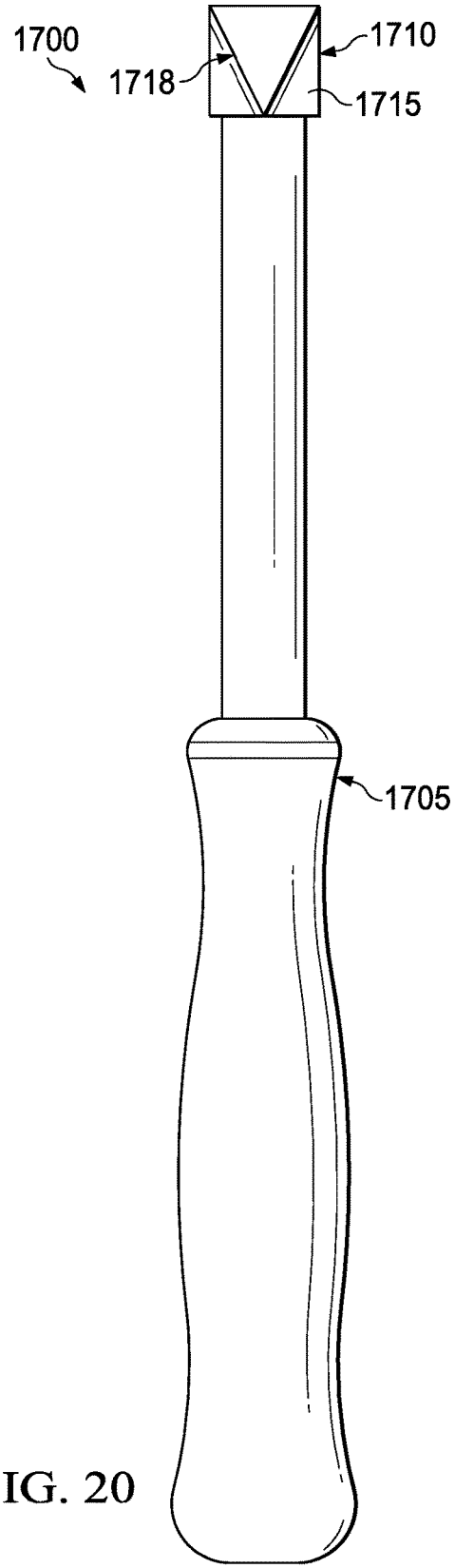
FIG. 20 is a back view of a texture hammer with ends of a hammer head having an inverted triangle shape in accordance with an exemplary embodiment of the present invention.
Figure 21:
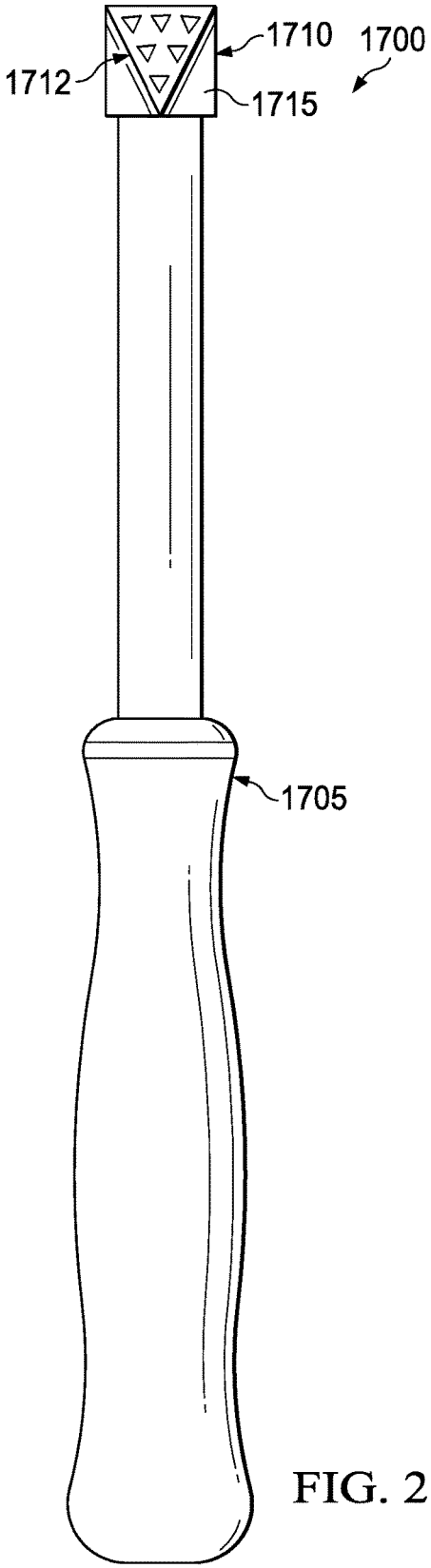
FIG. 21 is a front view of a texture hammer with ends of a hammer head having an inverted triangle shape in accordance with an exemplary embodiment of the present invention.
Figure 22:
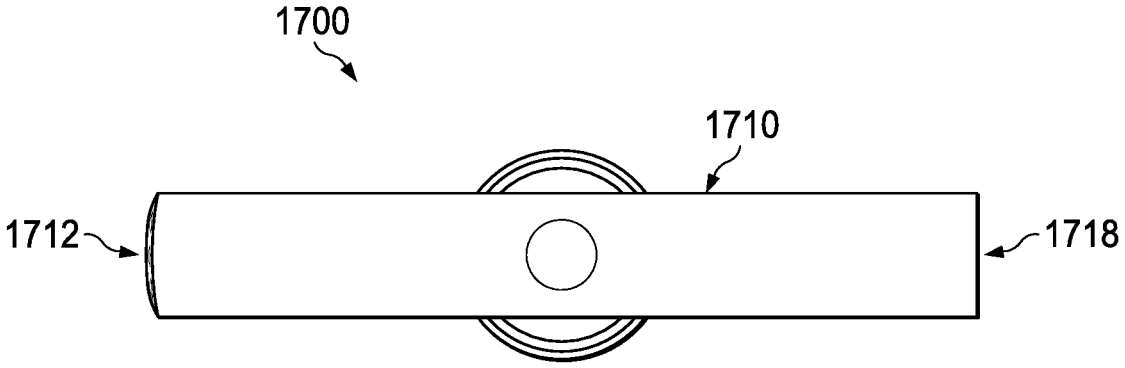
FIG. 22 is a top view of a texture hammer with ends of a hammer head having an inverted triangle shape in accordance with an exemplary embodiment of the present invention.
Figure 23:
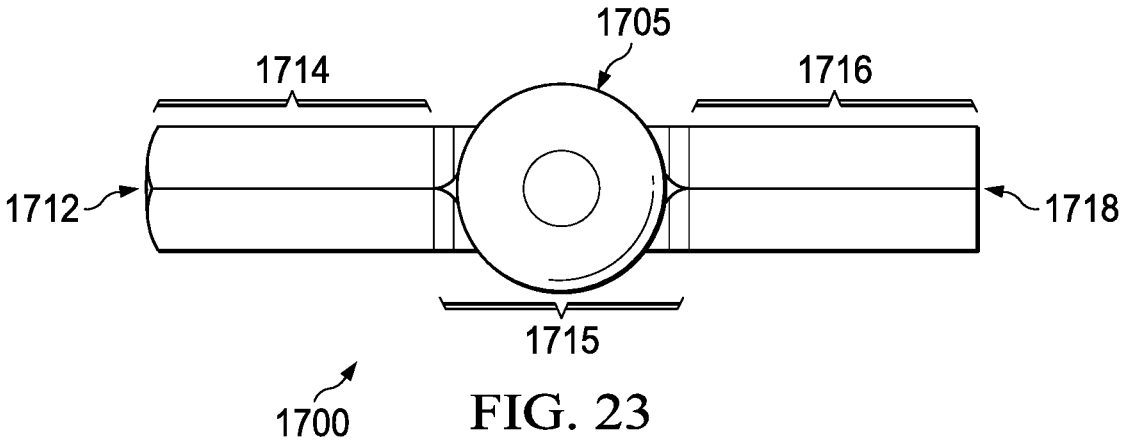
FIG. 23 is a bottom view of a texture hammer with ends of a hammer head having an inverted triangle shape in accordance with an exemplary embodiment of the present invention.
Figure 24:
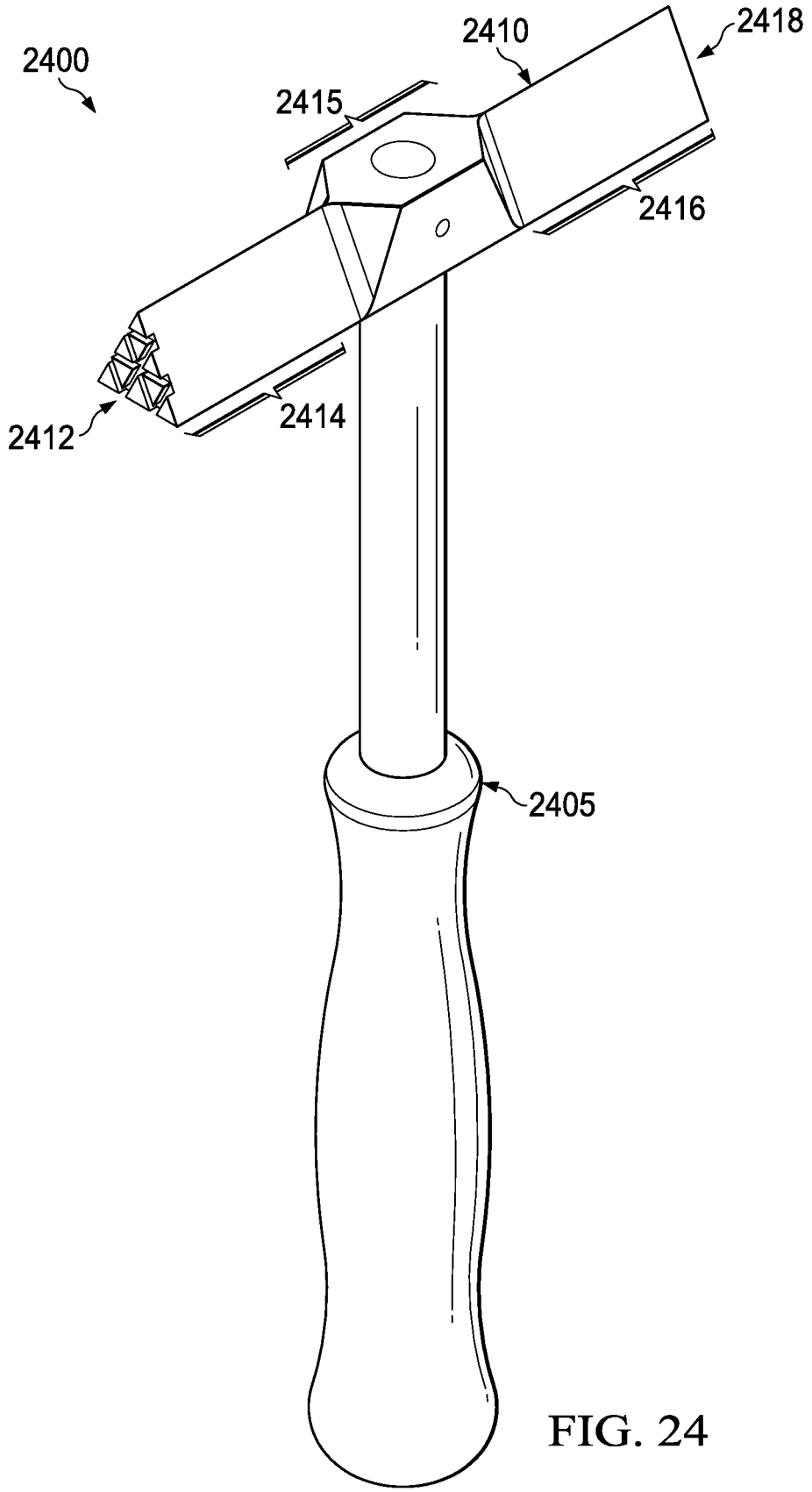
FIG. 24 is a perspective view of a texture hammer with ends of a hammer head having a triangle shape in accordance with an exemplary embodiment of the present invention.
Figure 25:
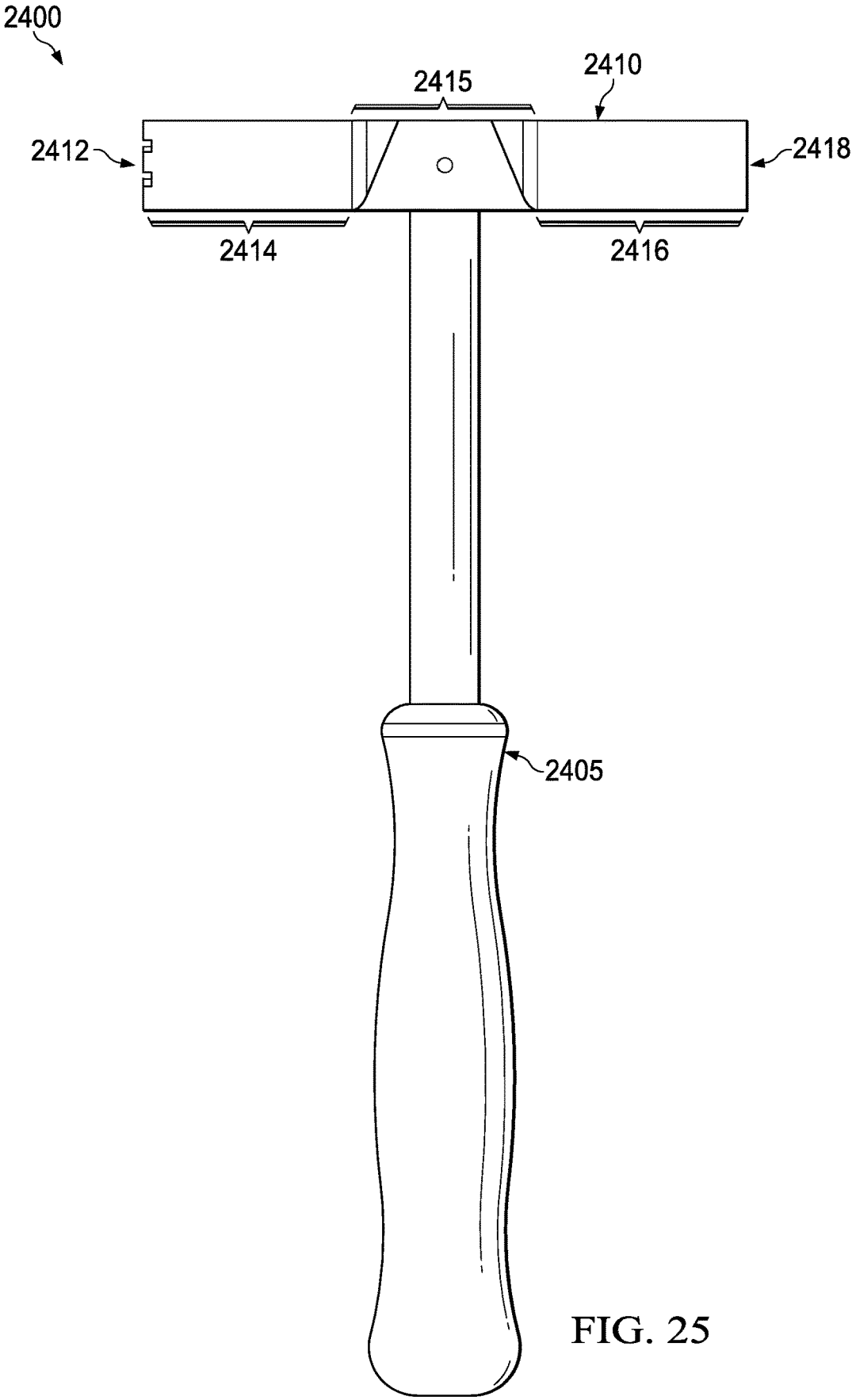
FIG. 25 is a right side view of the a texture hammer with ends of a hammer head having a triangle shape in accordance with an exemplary embodiment of the present invention.
Figure 26:
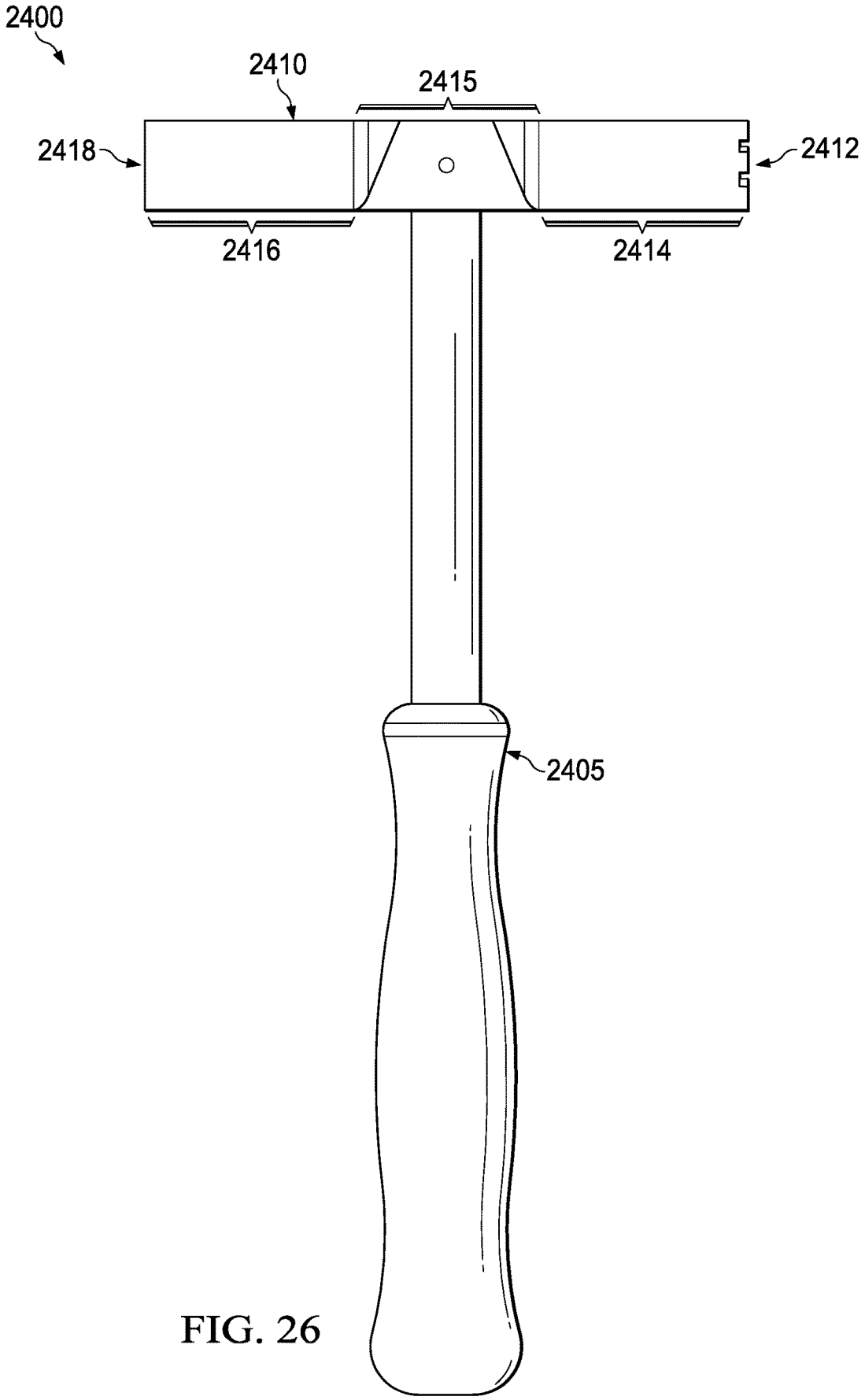
FIG. 26 is a left side view of a texture hammer with ends of a hammer head having a triangle shape in accordance with an exemplary embodiment of the present invention.
Figure 27:
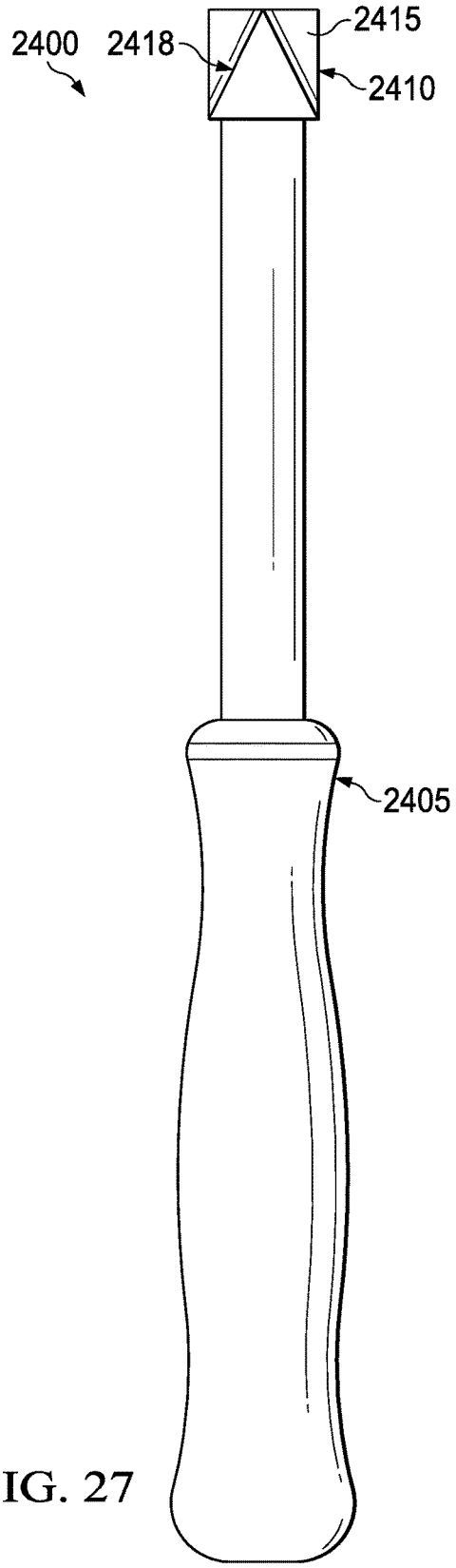
FIG. 27 is a back view of a texture hammer with ends of a hammer head having a triangle shape in accordance with an exemplary embodiment of the present invention.
Figure 28:
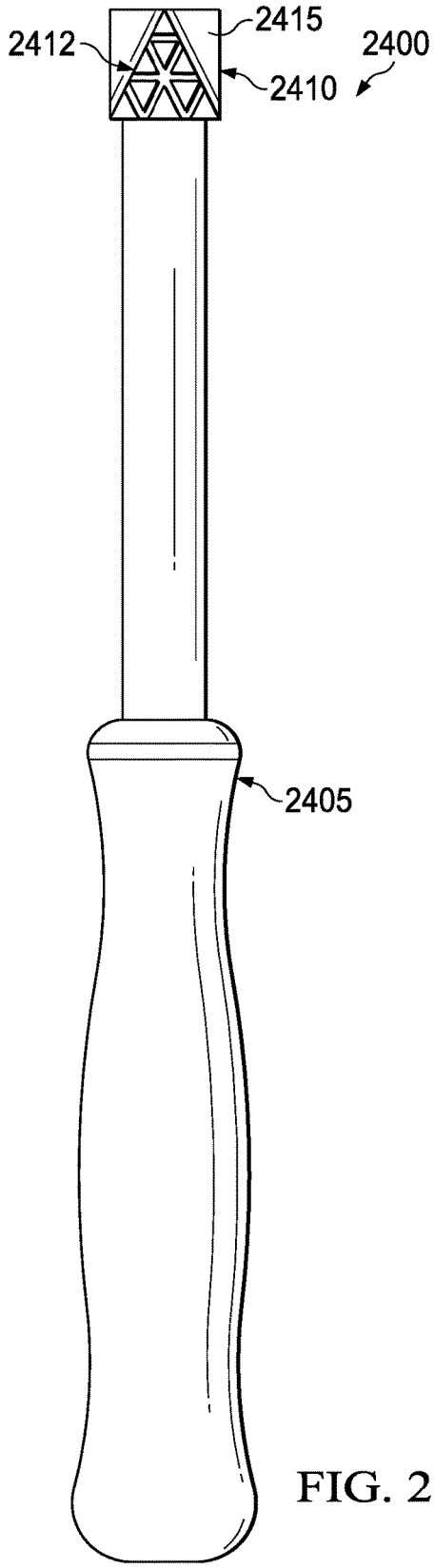
FIG. 28 is a front view of a texture hammer with ends of a hammer head having a triangle shape in accordance with an exemplary embodiment of the present invention.
Figure 29:
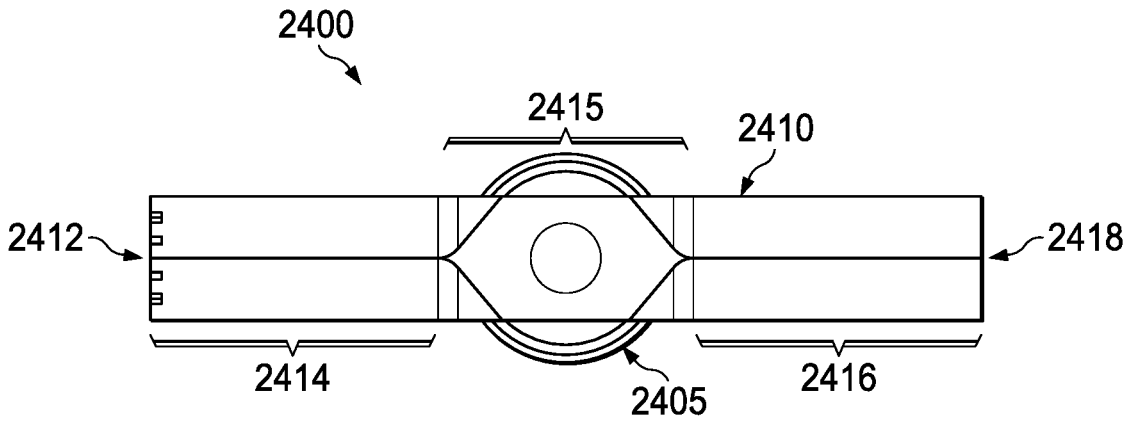
FIG. 29 is a top view of a texture hammer with ends of a hammer head having a triangle shape in accordance with an exemplary embodiment of the present invention.
Figure 30:
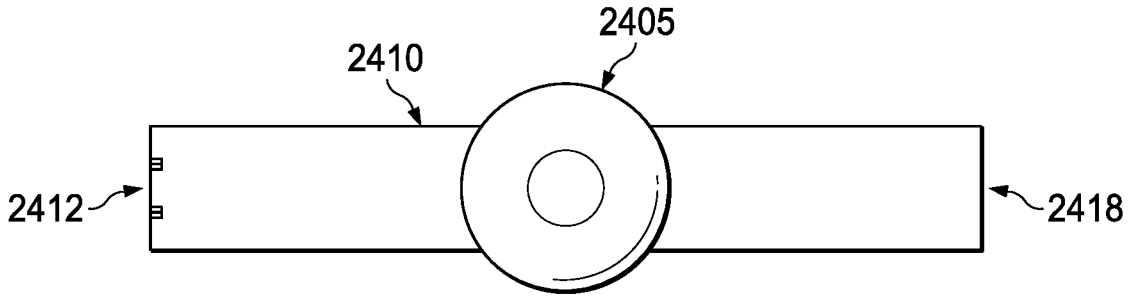
FIG. 30 is a bottom view of a texture hammer with ends of a hammer head having a triangle shape in accordance with an exemplary embodiment of the present invention.

Connected to the other side of the rectangular cross-section portion 915 is trapezoidal shaped portion 916 of the hammer head 910, and the trapezoidal shaped portion 916 ends with a curved rectangular end 918. The cross-section of the trapezoidal shaped portion 916 of the hammer head 910 is rectangular, and from a side view as shown in FIGS. 10 and 11, the hammer head 910 tapers in shape, like a trapezoid, before coming to a curved rectangular end 918. The trapezoidal prism shape of this portion 916 allows for greater control by the user in creating finer detailed work, and for greater focus of force when using the hammer 900 to create sharper and more defined texture patterns.

The curved rectangular end 918 may also be textured via indentations or protrusions on the surface of the curved rectangular end 918, like the square end 912, and the pattern of indentations or protrusions may be arranged in an arrangement complimentary to the arrangement on the surface of the curved square end 912. The curved rectangular end 918 is especially designed for making the border textures, which complement the texture on the curved square end 912.

The present exemplary embodiment of the texture hammer 900 may be manufactured to essentially any width/depth/height combination. In the embodiment shown in FIGS. 9-16, the hammer 900 measures approximately 9.5 inches in length (from the end of the handle 905 to the top of the hammer head 910), and weights approximately 1 pound 4.5 ounces. The hammer head is approximately 0.5 inches in length, approximately 4.125 inches in width (from the curved oval end 912 to the curved rectangular end 918), and approximately 0.5 inches in depth.

FIGS. 17-23 illustrate another embodiment of a texture hammer 1700 with ends 1712 and 1718 having an inverted triangle shape. The handle 1705 of texture hammer 1700 may be shaped similarly and function similarly to the handle of the texture hammer 100 in FIGS. 1-8. In this present exemplary embodiment of the texture hammer 1700, the hammer head 1710 may have any shape of cross-section, and may be described with reference to three portions: a textured triangle portion 1714, a connector portion 1715, and a smooth triangle portion 1716.

The textured triangle portion 1714 is connected to the connector portion 1715 of the hammer head 1710, and ends with a curved textured triangle end 1712. The textured triangle portion 1714 may be shaped like a triangular prism and may have a triangle cross-section, with a vertex of the triangle pointing downwards. The triangle cross-section may have any triangular shape: right, equilateral, isosceles, scalene, etc. The curved textured triangle end 1712 may be curved or rounded to prevent distortion or mutilation of the metallic material and to provide the user greater control of the hammer 1700 so as to not make any unintentional markings. The surface of the curved textured triangle end 1712 may comprise any number or arrangement of indentations or protrusions. In the exemplary embodiment illustrated in FIGS. 17-23, the curved textured triangle end 1712 has triangle-shaped indentions.

The connector portion 1715 is connected to the textured triangle portion 1714, and the smooth triangle portion 1716. The connector portion 1715 acts to connect the other portions of the hammer head 1710, and to stabilize the hammer head 1710 onto the handle 1705 of the hammer 1700. The connector portion 1715 may have any cross-sectional shape. The areas where the connector portion 1715 connects to the other portions of the hammer head 1710 may be arcuate or smoothed out in transitioning between the different portions of the hammer head 1710.

The smooth triangle portion 1716 is connected to the connector portion 1715, and is opposite the textured triangle portion 1714 of the hammer head 1710. The smooth triangle portion 1716 ends with a flat non-textured triangle end 1718. Like the textured triangle portion 1714, the smooth triangle portion 1716 may also be shaped like a triangular prism and may have a triangle cross-section, with a vertex of the triangle pointing downwards. The triangle cross-section may have any triangular shape: right, equilateral, isosceles, scalene, etc.

In the present exemplary embodiment, the surface of the flat non-textured triangle end 1718 is non-textured and is smooth, but in alternative embodiments, may have indentations and protrusions to create a texture complimentary to the textured triangle end 1712. The flat non-textured triangle end 1718 may be used to create a border texture, as further described below, because the shape of the hammer head 910, including the flat non-textured triangle end 1718, allows for creating sharper and more clearly defined texture patterns, especially along the borders of metallic materials.

The present exemplary embodiment of the texture hammer 1700 may be manufactured to essentially any width/depth/height combination. In the embodiment shown in FIGS. 17-23, the hammer 1700 measures approximately 9.5 inches in length (from the end of the handle 1705 to the top of the hammer head 1710), and weights approximately 1 pound 3.9 ounces. The hammer head 1710 is approximately 0.5 inches in length, approximately 4.125 inches in width (from the textured triangle end 1712 to the flat non-textured triangle end 1718), and approximately 0.5 inches in depth.

FIGS. 24-30 illustrate another embodiment of a texture hammer 2400 with ends 2412 and 2418 having a triangle shape. The handle 2405 of texture hammer 2400 may be shaped similarly and function similarly to the handle of the texture hammer 100 in FIGS. 1-8. In this present exemplary embodiment of the texture hammer 2400, the hammer head 2410 may have any shape of cross-section, and may be described with reference to three portions: a textured triangle portion 2414, a connector portion 2415, and a smooth triangle portion 2416.

The textured triangle portion 2414 is connected to the connector portion 2415 of the hammer head 2415, and ends with a textured triangle end 2412. The textured triangle portion 2414 may be shaped like a triangular prism and may have a triangle cross-section, with a vertex of the triangle pointing upwards. The triangle cross-section may have any triangular shape: right, equilateral, isosceles, scalene, etc. The textured triangle end 2412 may be curved or rounded to prevent distortion or mutilation of the metallic material and to provide the user greater control of the hammer 2400 so as to not make any unintentional markings. The surface of the textured triangle end 2412 may comprise any number or arrangement of indentations or protrusions. In the exemplary embodiment illustrated in FIGS. 24-30, the textured triangle end 2412 has linear indentions arranged to form triangles.

The connector portion 2415 is connected to the textured triangle portion 2414, and the smooth triangle portion 2416. The connector portion 2415 acts to connect the other portions of the hammer head 2410, and to stabilize the hammer head 2410 onto the handle 2405 of the hammer 2400. The connector portion 2415 may have a quadrilateral cross-section in the present exemplary embodiment, but may have any cross-sectional shape in alternate embodiments. The areas where the connector portion 2415 connects to the other portions of the hammer head may be arcuate or smoothed out in transitioning between the different portions of the hammer head 2410.

The smooth triangle portion 2416 is connected to the connector portion 2415, and is opposite the textured triangle portion 2414 of the hammer head 2414. The smooth triangle portion 2416 ends with a flat non-textured triangle end 2418. Like the textured triangle portion 2414, the smooth triangle portion 2416 may also be shaped like a triangular prism and may have a triangle cross-section, with a vertex of the triangle pointing upwards. The triangle cross-section may have any triangular shape: right, equilateral, isosceles, scalene, etc. In the present exemplary embodiment, the surface of the flat non-textured triangle end 2418 is non-textured and is smooth, but in alternative embodiments, may have indentations and protrusions to create a texture complimentary to the textured triangle end 2412.

The present exemplary embodiment of the texture hammer 2400 may be manufactured to essentially any width/depth/height combination. In the embodiment shown in FIGS. 24-30, the hammer 2400 measures approximately 9.5 inches in length (from the end of the handle 2405 to the top of the hammer head 2410), and weights approximately 1 pound 4 ounces. The hammer head 2410 is approximately 0.5 inches in length, approximately 4.125 inches in width (from the textured triangle end 2412 to the flat non-textured triangle end 2418), and approximately 0.5 inches in depth.

Figure 31:
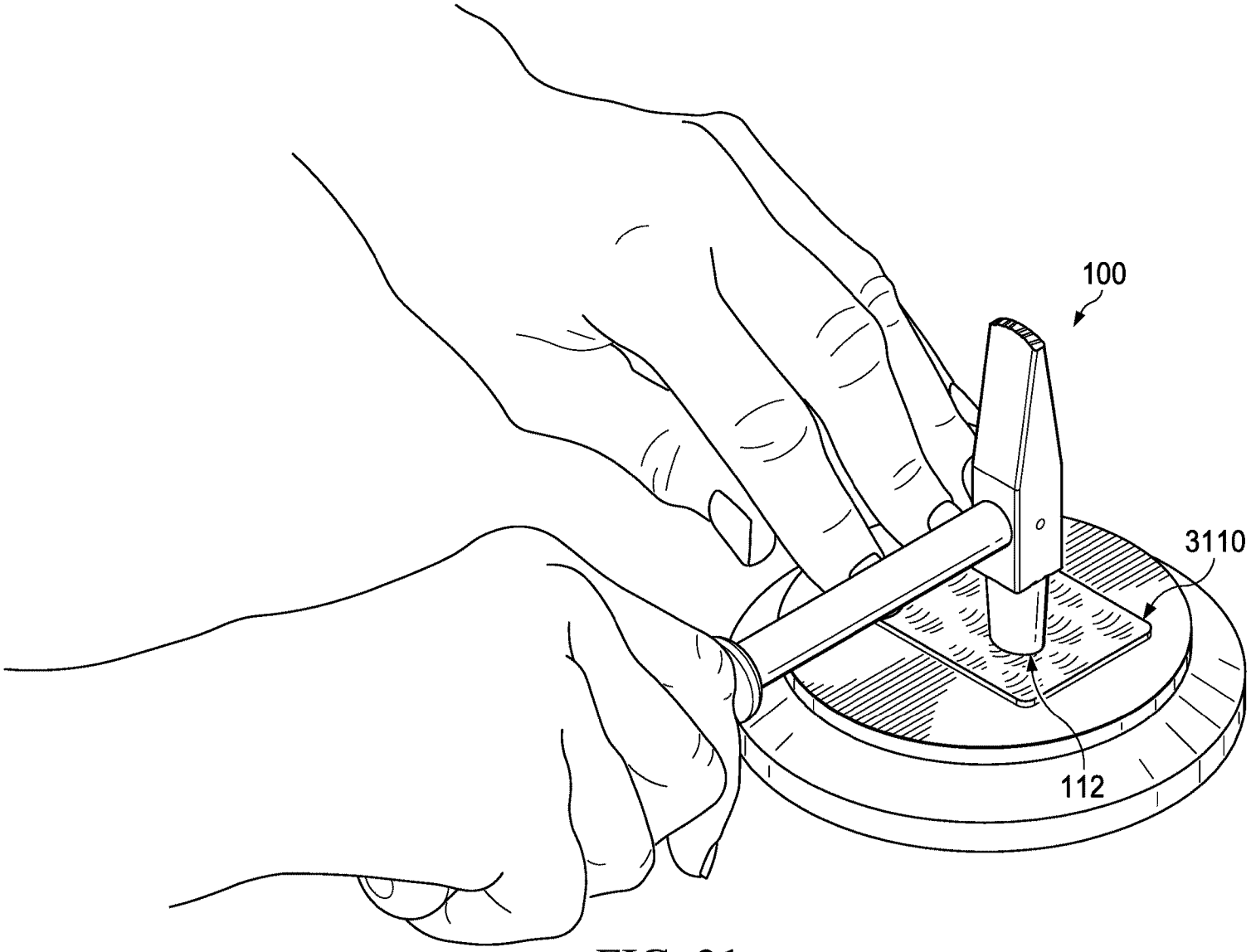
FIGS. 31-32 illustrate a method of using a texture hammer to make a texture accordance with an embodiment of the invention.
Figure 32:
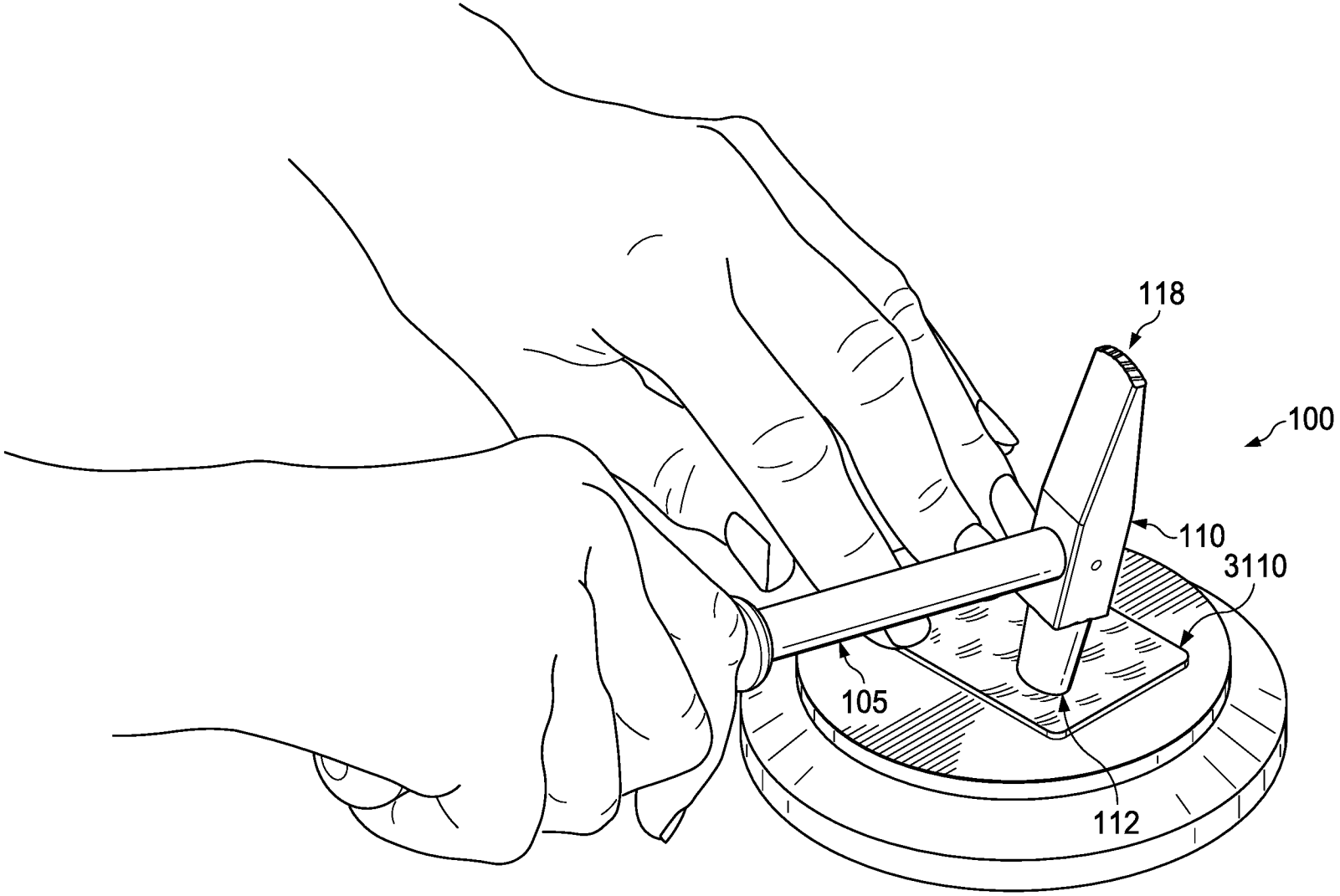

Referring now to FIGS. 31-32, a method of using the textured hammers (any previously discussed embodiment) to make a texture on a flat metallic material 3110 is illustrated. The method may be used on any non-ferrous metals that tend to be softer, such as sterling silver, fine silver, Argentium silver, brass, copper, niobium, aluminium, and gold; and occasionally, steel and other ferrous metals may be used. FIGS. 31-32 illustrate the method using the oval textured hammer of FIGS. 1-8, but the method may be used with other textures hammers, such as the square end texture hammer 800, the inverted triangle hammer 1700, and the triangle hammer 2400. To make a texture on a flat metallic material 3110 with the oval texture hammer as shown in FIG. 31, the handle 105 of the hammer 100 is gripped firmly as the oval end 112 is applied to/strikes the flat metallic material 3110 so that the length of the hammer head 110 is approximately perpendicular to the material 3110. The texture on the oval end 112, when applied to the material 3110, creates a complimentary texture on the flat metallic material 3110, and repeat applications of the oval end 112 to the material 3110 may create uniform and identical markings or texture patterns on the material 3110.

The user may also alter the angle of the hammer 100 so that when the oval end 112 meets the flat metallic material 3110, a different marking or texture pattern appears on the material 3110. As shown in FIG. 32, the user may angle the oval end 112 of the hammer head 110 at differing angles when applied to the material 3110. The angle of oval end 112 of the hammer 100 in FIG. 32 is a different angle as compared to the angle of application in FIG. 31 where the length of the hammer head 110 is perpendicular to the material 3110. Because the oval end 112 is curved or rounded in shape and the texture of the oval end 112 conforms to the roundness of the oval end 112, the point of contact of the oval end 112, when using a different angle as shown in FIG. 32, creates a different marking or texture pattern. A user of the texture hammer (any one of the presently disclosed texture hammers) may be able to use differing angles of application of the texture hammer to a flat metallic material 3110 (or any other metallic surface) to create a non-uniform texture pattern.

Figure 33:
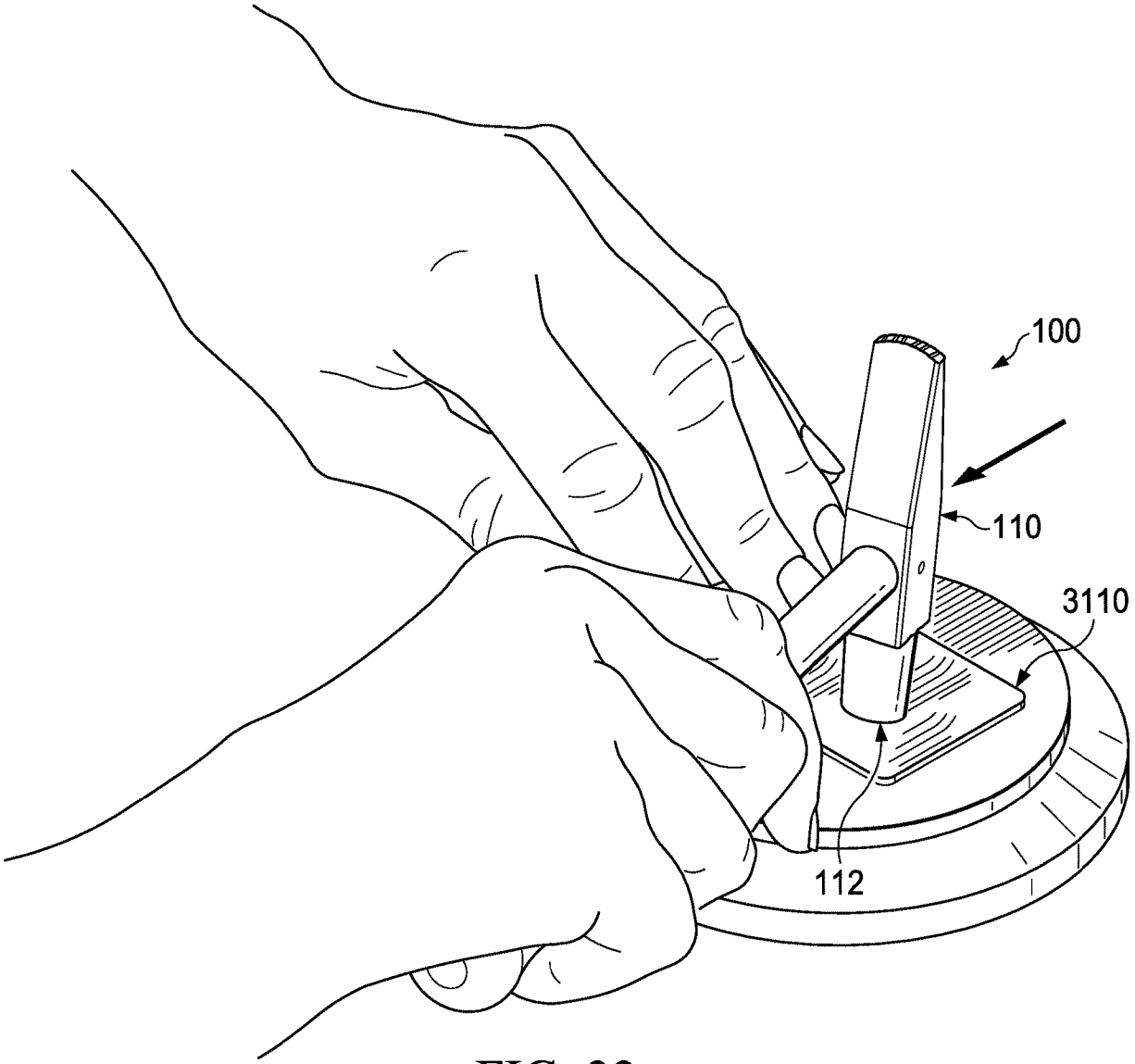
FIGS. 33-34 illustrate a method of using a texture hammer to make a texture in accordance with an embodiment of the invention
Figure 34:
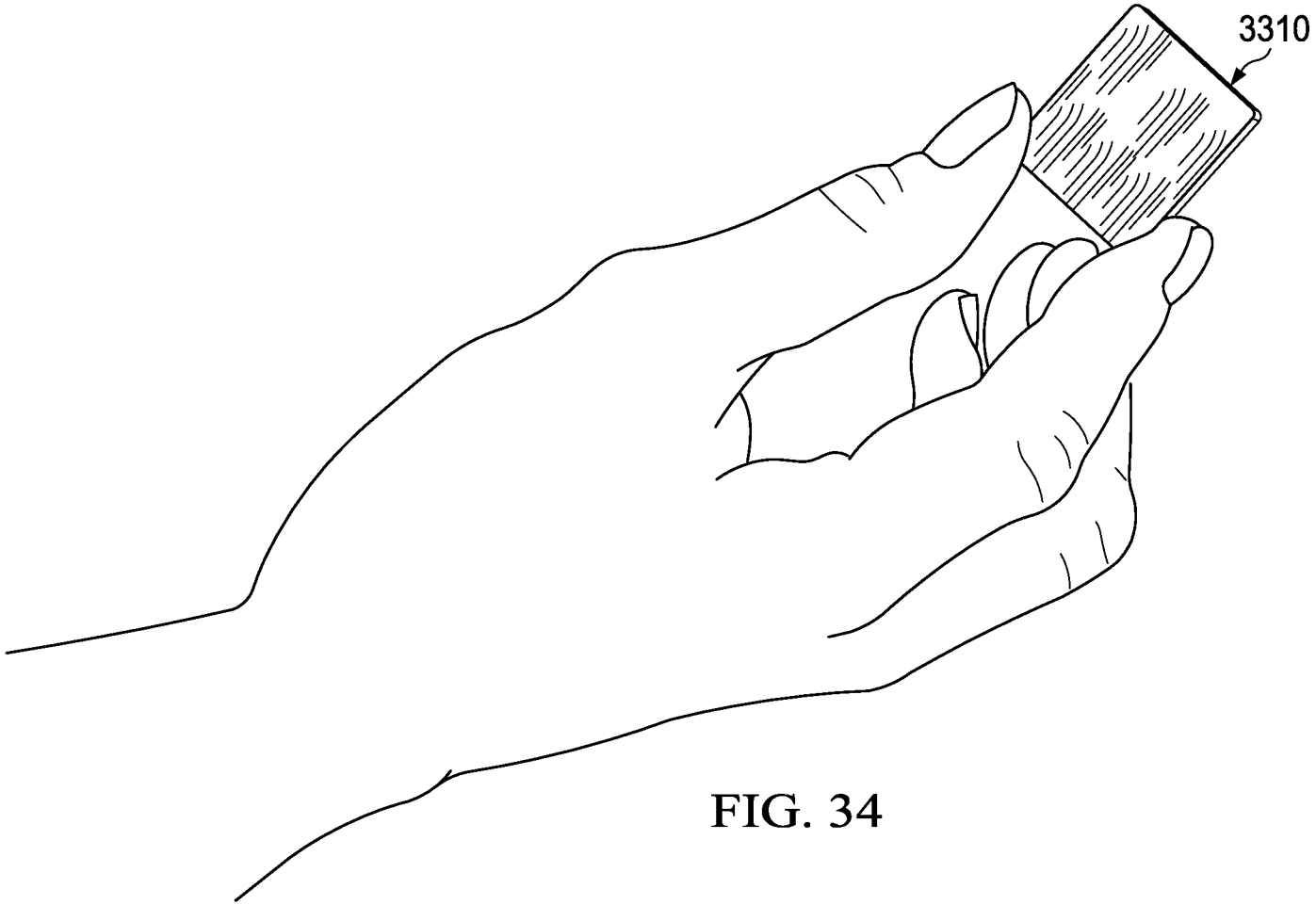

Referring now to FIGS. 33-34, a method of using the oval texture hammer 100 to make a texture in accordance with an embodiment of the invention is illustrated. The method may be used on any non-ferrous metals that tend to be softer, such as sterling silver, fine silver, Argentium silver, brass, copper, niobium, aluminium, and gold; and occasionally, steel and other ferrous metals may be used. FIGS. 33-34 illustrate the method using the oval texture hammer 100, but the method may be used with other textures hammers, such as the square end texture hammer 800, the inverted triangle hammer 1700, and the triangle hammer 2400. To make a texture on a flat metallic surface 3110 as shown in FIGS. 33-34, the handle 105 is gripped firmly as the oval end 112 of the hammer head 110 contacts the surface of the flat metallic material 3110. Contact between the oval end 112 of the hammer 100 and the surface of the flat metallic material 3110 may create markings or texture patterns in the surface of the flat metallic material 3110 as the user drags the oval end 112 of the hammer across the surface of the flat metallic material 3110. Repeat applications of the user dragging the oval end 112 of the hammer 100 across the surface of the material 3110 may create a texture pattern, as shown in FIG. 34. Further, the user may vary the force applied while dragging the oval end 112 of the hammer 100 across the surface of the material 3110, so as to create different textures and patterns on the surface of the material 3110. The user may also vary the length of the line patterns created by the user dragging the oval end 112 of the hammer 100 across the surface of the material 3110, so as to create patterns with lines of differing lengths.

Figure 35:
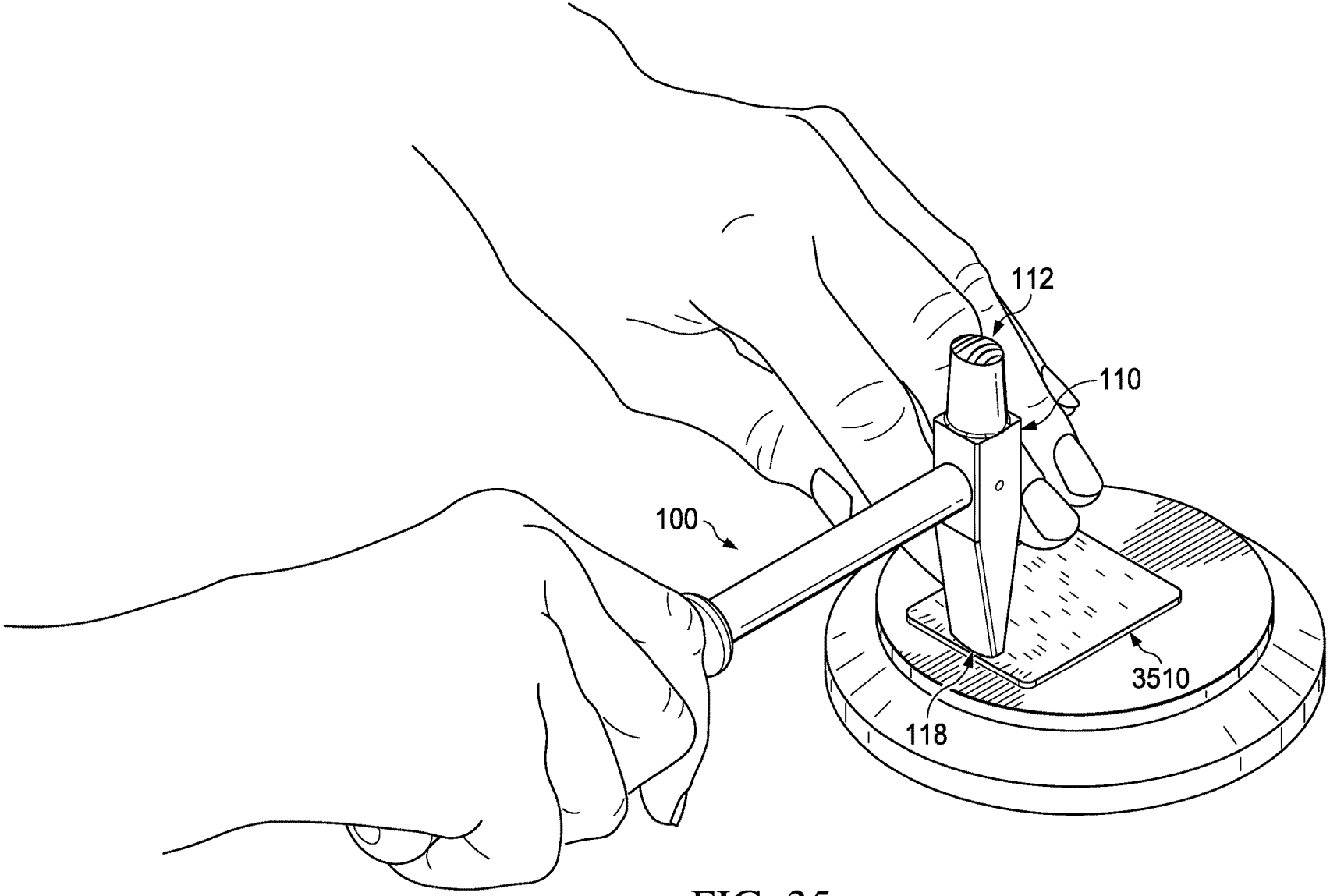
FIGS. 35-37 illustrate a method of using the texture hammers to create a texture border in accordance with an embodiment of the invention.
Figure 36:
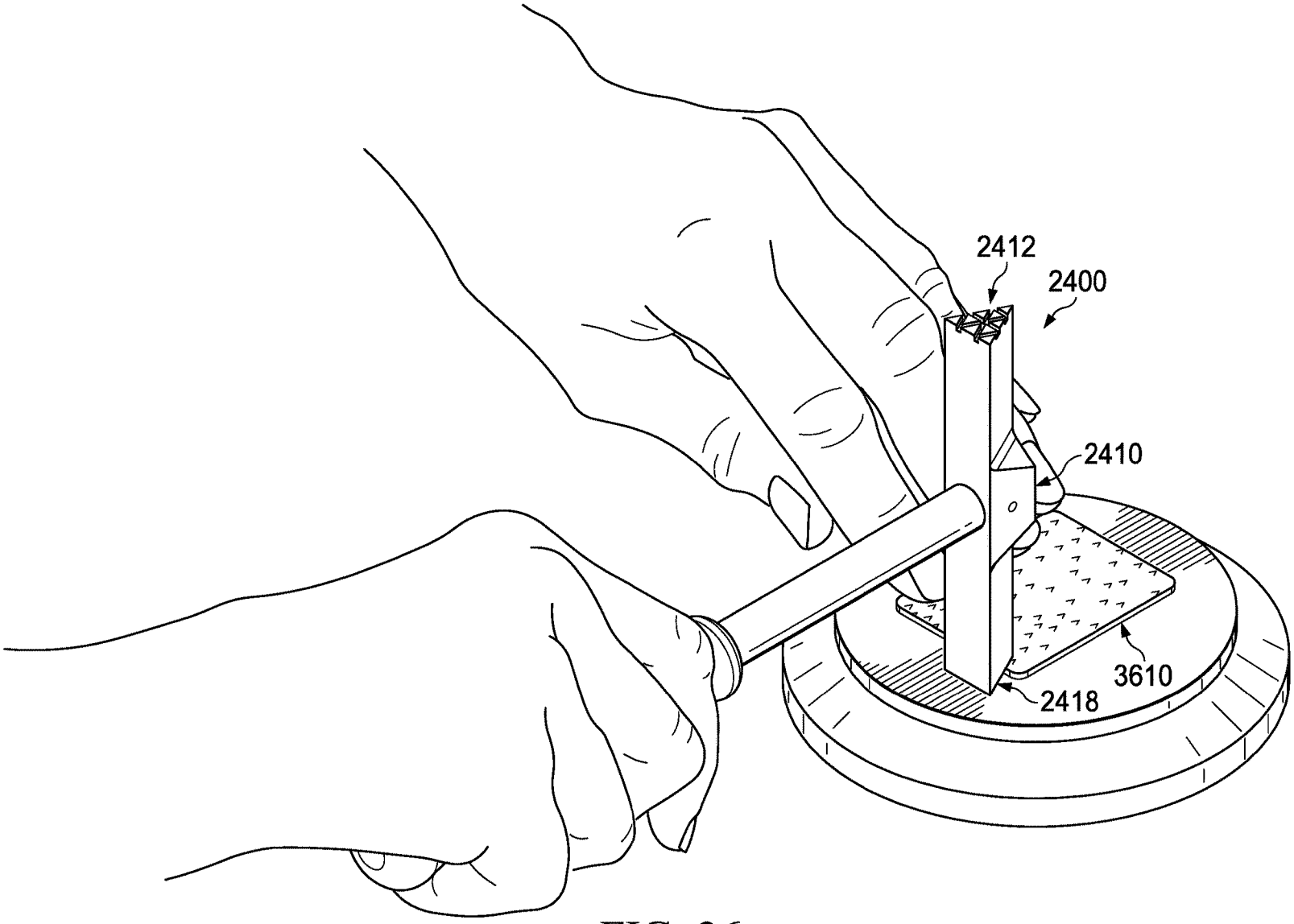
Figure 37:
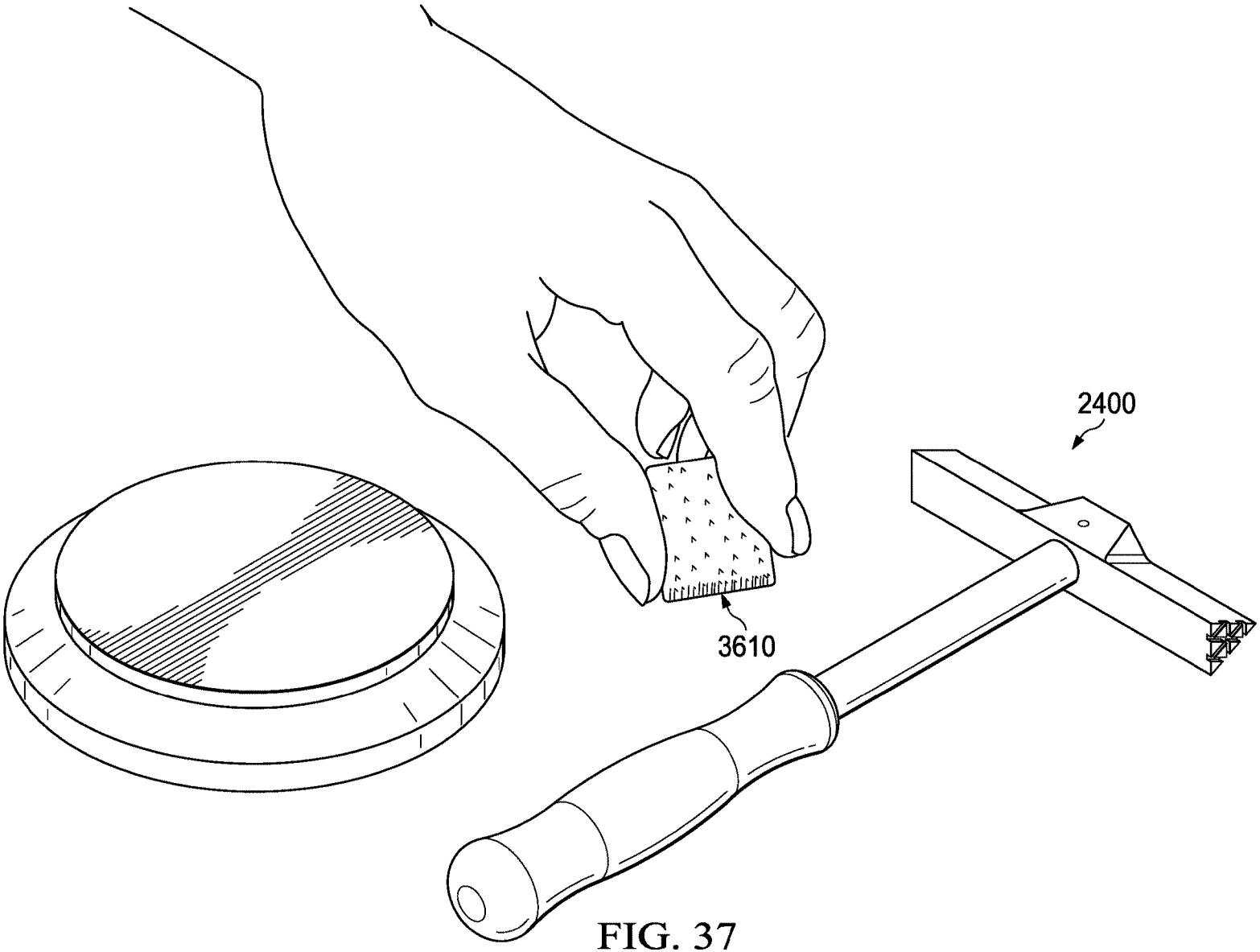

Referring now to FIGS. 35-37, a method of using the texture hammers to create a texture border in accordance with an embodiment of the invention is illustrated. The method may be used on any non-ferrous metals that tend to be softer, such as sterling silver, fine silver, Argentium silver, brass, copper, niobium, aluminium, and gold; and occasionally, steel and other ferrous metals may be used. FIGS. 35-37 illustrate the method using the oval texture hammer 100 in FIG. 35 and the triangle hammer 2400 in FIGS. 36-37, but the method may be used with other texture hammers, such as such as the square end texture hammer 800 and the inverted triangle hammer 1700.

As shown in FIG. 35, to make a texture border using the oval end texture hammer 100, a flat metallic material 3510 is steadied, and the hammer 100 is gripped firmly as the user aligns the curved rectangular end 118 of the hammer 100 to the edge of flat metallic material 3510. Because the curved rectangular end 118 has a smaller surface area as compared to the oval end 112, the curved rectangular end 118 is better suited for creating a texture border and the user has greater control over the application of the curved rectangular end 118 to the edge of the material 3510. After aligning the curved rectangular end 118 to the edge of the material 3510, the user may apply the curved rectangular end 118 of the hammer 100 to the material 3510 so as to create a texture in the surface of the material 3510, and the user may repeatedly hammer along the length of the edge of the material with the curved rectangular end 118. After repeat applications of the curved rectangular end 118 to the edge of the material 3510, a texture pattern appears on the edge of the material so as to appear as a texture border of the material 3510, as shown in FIG. 35. The method to make a texture border may then be applied to all edges of the flat metallic material 3510.

As shown in FIGS. 36-37, to make a border texture using the triangle texture hammer 2400, a flat metallic material 3610 is steadied, and the hammer 2400 is gripped firmly as the user aligns the flat non-textured end 2418 to the edge of the flat metallic material 3610. Unlike the oval end texture hammer 100 which has a curved rectangular end 118 for creating textures on a smaller area, the triangle hammer 2400 does not have an end with a smaller surface area as compared to the other end of the triangle hammer 2400. In order to create a border texture using the triangle texture hammer 2400, the user may angle the triangle texture hammer 2400 so that the edge of the flat non-textured end 2418 is applied to the edge of the material 3610. For example, the user may tilt the triangle texture hammer 2400 over so that the edge of the hammer head 2410 (the sides of the flat non-textured end 2418 or the tips of the flat non-textured end 2418) will strike the edge of the material to create a border texture. The tips of the flat non-textured end 2418 allow the user to better control and predict where the hammer 2400 will strike, and thereby allows the user to create a more consistent border texture than the oval end 112 of texture hammer 100. After repeat applications of the edge of the flat non-textured end 2418 along the length of the edge of the material 3610, a texture pattern appears on the edge of the material 3610, where the flat non-textured end 2418 of the hammer 2400 was applied. The texture pattern may appear as a texture border on the flat metallic material 3610, as shown in FIG. 37, and the method to create the texture may also be applied to all edges of the material 3610 so as to create a texture border on all edges.

The invention may be embodied in other specific forms without departing from the spirit or essential characteristics thereof. The present embodiments are therefore to be considered in all respects as illustrative and not restrictive. Accordingly, the scope of the invention is established by the appended claims rather than by the foregoing description. All changes which come within the meaning and range of equivalency of the claims are therefore intended to be embraced therein. Further, the recitation of method steps does not denote a particular sequence for execution of the steps. Such method steps may therefore be performed in a sequence other than recited unless the particular claim expressly states otherwise.

I claim:

1. A hammer for ornamenting metallic surfaces, comprising:

a handle with two ends; and a hammer head attached to one of the two ends of the handle, wherein the hammer head has a first end and a second end, wherein the first end and the second end have a triangle cross-section shape, wherein the triangle cross-section shape comprises three sides, and wherein one of the three sides lies on a plane perpendicular to the length of the handle, wherein the first end of the hammer head comprises a first plurality of indentations to create a texture on a surface of the first end of the hammer head, wherein the second end of the hammer head comprises a second plurality of indentations to create a texture on a surface of the second end of the hammer head.

2. The hammer of claim 1, wherein the second plurality of indentations is complementary to the first plurality of indentations.

3. The hammer of claim 1, wherein the first plurality of indentations comprise triangle-shaped indentations, and the triangle-shaped indentations comprise three sides with at least one side parallel to at least one side of the triangle cross-section shape.

4. The hammer of claim 1, wherein the first plurality of indentations comprise linear indentations, wherein the linear indentations intersect edges of the triangle cross-section shape of the first end so to create triangle-shaped protrusions comprising three sides with at least one side parallel to at least one side of the triangle cross-section shape.

5. The hammer of claim 1, wherein a portion of the hammer head has a square cross-section shape.

6. The hammer of claim 1, wherein the first end of the hammer head is curved.

7. The hammer of claim 1, wherein the second end of the hammer head is flat.

8. The hammer of claim 1, wherein the handle is made of wood.

9. The hammer of claim 1, wherein the handle comprises an ergonomic shape designed to provide a comfortable grip.

* * * * *